US008347988B2

(12) United States Patent
Gilbert et al.

(10) Patent No.: US 8,347,988 B2
(45) Date of Patent: Jan. 8, 2013

(54) DOWN-HOLE HAMMER DRILL

(76) Inventors: Andrew S. Gilbert, Welshpool (AU); Barry J Thompson, Berkshire (GB)

( * ) Notice: Subject to any disclaimer, the term of this patent is extended or adjusted under 35 U.S.C. 154(b) by 0 days.

(21) Appl. No.: 12/709,988

(22) Filed: Feb. 22, 2010

(65) Prior Publication Data

US 2010/0252330 A1 Oct. 7, 2010

Related U.S. Application Data

(63) Continuation-in-part of application No. PCT/AU2008/001229, filed on Aug. 21, 2008.

(30) Foreign Application Priority Data

Aug. 21, 2007 (AU) ..... 2007904502

(51) Int. Cl.
*E21B 4/00* (2006.01)

(52) U.S. Cl. ..... 175/293; 175/414; 175/415

(58) Field of Classification Search ..... 175/414, 175/415, 293

See application file for complete search history.

(56) References Cited

U.S. PATENT DOCUMENTS

| | | | | |
|---|---|---|---|---|
| 5,984,596 | A | 11/1999 | Fehrle et al. | |
| 6,938,710 | B2 | 9/2005 | Simmons | |
| 6,994,175 | B2 | 2/2006 | Egerstrom | |
| 7,527,110 | B2 * | 5/2009 | Hall et al. | 175/420.2 |
| 7,581,602 | B2 | 9/2009 | Lorger et al. | |
| 2004/0188146 | A1 | 9/2004 | Egerstrom | |
| 2004/0262042 | A1 | 12/2004 | Simmons | |
| 2007/0007045 | A1 | 1/2007 | Lorger et al. | |

FOREIGN PATENT DOCUMENTS

| | | |
|---|---|---|
| AU | 2006203631 | 3/2007 |
| WO | WO 2007/010513 A1 | 1/2007 |

OTHER PUBLICATIONS

International Search Report based on International Application No. PCT/AU2008/001229.

* cited by examiner

*Primary Examiner* — William P Neuder
*Assistant Examiner* — Yong-Suk (Philip) Ro
(74) *Attorney, Agent, or Firm* — Greenberg Traurig, LLP; David J. Dykeman; Roman Fayerberg

(57) ABSTRACT

A down-hole hammer comprising a drill bit (10) and a drive collar (11) with an interconnection therebetween for causing rotation of the drill bit upon rotation of the drive collar. The drill bit (10) comprises a drill bit head (13) and a shank (19), the drill bit head (13) defining a cutting face (15) and having a circumferential shoulder section (17) adjacent the cutting face (15). The shank (19) extends from the shoulder section (17) in the direction away from the cutting face (15). The interconnection between the drill bit (10) and the drive collar (11) comprises a spline assembly including at least one spline (43) on the shoulder section (17) for mating engagement with at least one counterpart spline (63) on the drive collar (11) to provide a drive coupling therebetween while also allowing the drill bit (10) to slide axially within the drive collar (11) to perform a percussive action.

22 Claims, 24 Drawing Sheets

10
93
82
94
71
11
141

10
27
15
13
82
21
21
93
20
20
94
19
19
19
25
91
11

29
13
15
11
27
17
18
18
17
10

10
93
11

93
25
19
94
11
10

25
31
31
10
11
91
19

DOWN-HOLE HAMMER DRILL

RELATED APPLICATIONS

This application is a continuation-in-part of PCT International Application No. PCT/AU2008/001229, filed Aug. on 21, 2008, which claims the benefit of Australian Provisional Patent Application 2007904502, filed on Aug. 21, 2007, and the entirety of both these applications are hereby incorporated herein by reference for the teachings therein.

FIELD OF THE INVENTION

This invention relates to a down-hole hammer and to a drill bit for such a down-hole hammer.

BACKGROUND ART

The following discussion of the background art is intended to facilitate an understanding of the present invention only. The discussion is not an acknowledgement or admission that any of the material referred to is or was part of the common general knowledge as at the priority date of the application.

A down-hole hammer typically comprises a drill shank and a percussive drill head assembly at the working end of the drill shank. The percussive drill head assembly incorporates a drill bit. The drill bit typically comprises a drill bit head defining a cutting face and a shank extending from the drill bit head away from the cutting face. The drill bit is retained in a drill bit retaining means commonly referred to as a drive sub. The shank of the drill bit incorporates splines which cooperate with counterpart splines on the drive sub, the arrangement being that rotational torque applied to the drive sub is transmitted to the drill bit through the mating splines while allowing reciprocatory movement of the drill bit in response to percussive blows delivered by an air-operated percussive hammer. The splines are arranged to provide channels along which exhaust air from the percussive hammer can flow. The drill bit retaining means further comprises a retaining flange provided on the shank. The retaining flange is adapted to be engaged by a retaining ring for retaining the drill bit within the drive sub while permitting reciprocatory movement of the drill bit in response to percussive blows from the percussive hammer.

In operation of the down-hole hammer, the drill bit is subjected to high energy percussive impacts and rotational torque loads which are delivered through the shank. In particular, the high energy percussive impacts are delivered to the strike end of the shank and the high rotational torque loads are delivered through the splines provided on the shank.

The continual loadings on the drill bit through the drill shank can lead to material fatigue, a consequence of which is that the drill bit can fracture in the region adjacent the intersection between the shank and the drill bit head. This is most undesirable, as not only does the fractured drill bit need to be discarded and replaced, but also there is time involved in withdrawing the drill shank for the replacement of the fractured drill bit. Further, there may also be lost time if the drill bit head separates from the down-hole hammer, thereby requiring it to be retrieved separately from the bore hole.

It is against this background, and the problems and difficulties associated therewith, that the present invention has been developed.

DISCLOSURE OF THE INVENTION

According to a first aspect of the invention there is provided a down-hole hammer comprising a drill bit and a drive means for rotating the drill bit, the drill bit comprising a drill bit head and a shank, the drill bit head defining a cutting face and having a circumferential shoulder section adjacent the cutting face, the shank extending from the shoulder section in the direction away from the cutting face, the drive means comprising a spline assembly comprising at least one spline on the shoulder section for mating engagement with at least one counterpart spline on a surrounding part of the drive means to provide a drive coupling therebetween.

With this arrangement, rotational torque is delivered directly to the drill bit head through the mating splines and there is no torque transfer through the shank.

Preferably, there are plurality splines on the shoulder section for mating engagement in counterpart relation with splines on a surrounding part of the drive means.

Preferably, the splines are adapted to interlock when in mating engagement to releasably retain the drill bit in position with respect to the drive means.

Typically, the drive means comprises a drive collar.

Preferably, each spline comprises two spline sections circumferentially offset with respect to each other.

Preferably, the spline sections on one part (the drive means or the drill bit) define a retention gap into which one spline section of a counterpart spline section on the other part (the drive means or the drill bit) can be received, with the spline sections in engagement to provide a drive coupling therebetween.

Preferably, the retention gap is closed at one end to prevent axial separation between the drill bit and the drive means. The gap may be closed by a circumferential web extending between the two spline sections.

Preferably, a clearance space is defined at one end of one spline section defining the retention gap to permit the counterpart spline section to pass therethrough and be moved into alignment with the retention gap upon relative rotation between the drill bit and the drive means.

According to a second aspect of the invention there is provided a down-hole hammer comprising a drill bit and a drive collar with an interconnection therebetween for causing rotation of the drill bit upon rotation of the drive collar, the drill bit comprising a drill bit head and a shank, the drill bit head defining a cutting face and having a circumferential shoulder section adjacent the cutting face, the shank extending from the shoulder section in the direction away from the cutting face, the interconnection between the drill bit and the drive sub comprising a spline assembly comprising at least one spline on the shoulder section for mating engagement with at least one counterpart spline on the drive collar to provide a drive coupling therebetween.

According to a third aspect of the invention there is provided an assembly comprising a drill bit and a drive member (such as a drive collar) with an interconnection therebetween for causing rotation of the drill bit upon rotation of the drive member, the drill bit comprising a drill bit head and a shank, the drill bit head defining a cutting face and having a circumferential shoulder section adjacent the cutting face, the shank extending from the shoulder section in the direction away from the cutting face, the interconnection between the drill bit and the drive member comprising a spline assembly comprising at least one spline on the shoulder section for mating engagement with at least one counterpart spline on the drive member to provide a drive coupling therebetween.

According to a fourth aspect of the invention there is provided a drill bit comprising a drill head defining a cutting face and having a circumferential shoulder section adjacent the cutting face, a shank extending from the shoulder face, and at least one spline provided on the shoulder section to cooperate with a mating spline on a part of a down-hole hammer in which the drill bit is adapted to be received.

BRIEF DESCRIPTION OF THE DRAWINGS

The invention will be better understood by reference to the following description of several specific embodiments thereof as shown in the accompanying drawings in which.

BEST MODE(S) FOR CARRYING OUT THE INVENTION

Figure 1:
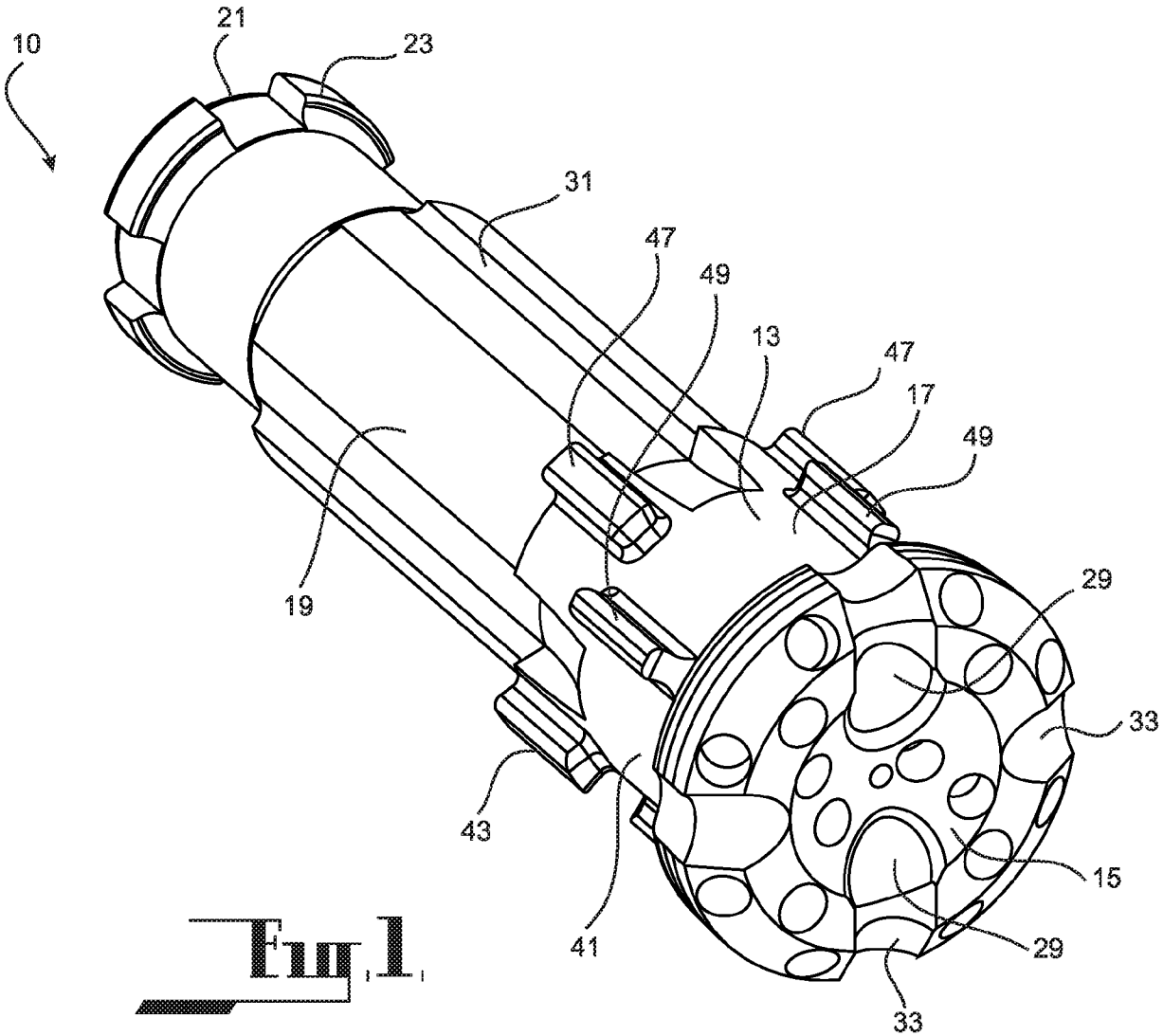
FIG. 1 is a perspective view of a drill bit of a down-hole hammer according to a first embodiment.

Referring to FIGS. 1 to 11, the first embodiment is directed to a percussive down-hole hammer comprising a drill bit 10 and a drive collar 11 in which the drill bit can be received.

The drill bit 10 comprises a drill bit head 13 which defines a cutting face 15 and which has a circumferential shoulder section 17 adjacent the cutting face. A shank 19 extends from the shoulder section 17 in the direction away from the cutting face 15 and terminates at a strike face 21. An air-operated percussive hammer (not shown) is incorporated in the down-hole hammer to impact percussive blows to the strike face 21, in known manner. A retaining flange 23 is provided on the shank 19 adjacent the strike face 21. A central hole 25 extends through the drill bit 10 from the strike face 22 to branch holes 27 which open on to the cutting face 15 at collection ports 29. The central hole 25 is adapted to receive an air conduit. The branch holes 27 and the central hole 25 provide a path for return air flow through the centre of the drill bit, as is well known.

The shank 19 incorporates circumferentially spaced channels 31 for exhaust air from the percussive hammer to flow between the drill bit 10 and the surrounding drive sub 11. The channels 31 communicate with peripheral channels 33 in the drill head 13 from which the exhaust air flows across the cutting face 15 and into the collection ports 29, carrying drilling debris with it.

The shoulder section 17 defines a circumferential face 41 on which splines 43 are provided.

Figure 10:
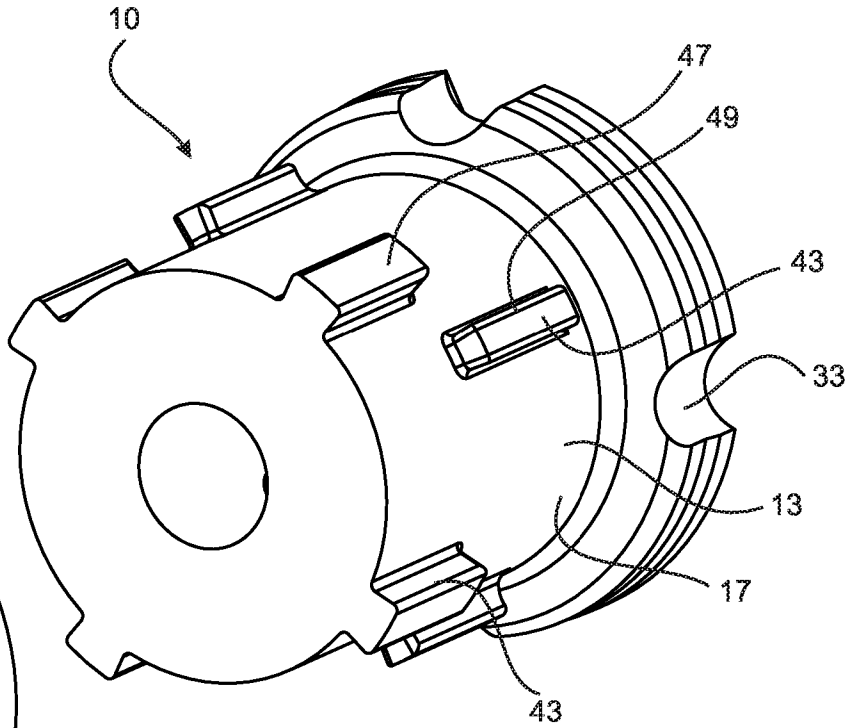
FIG. 10 is a fragmentary view of part of the drill bit.
Figure 11:
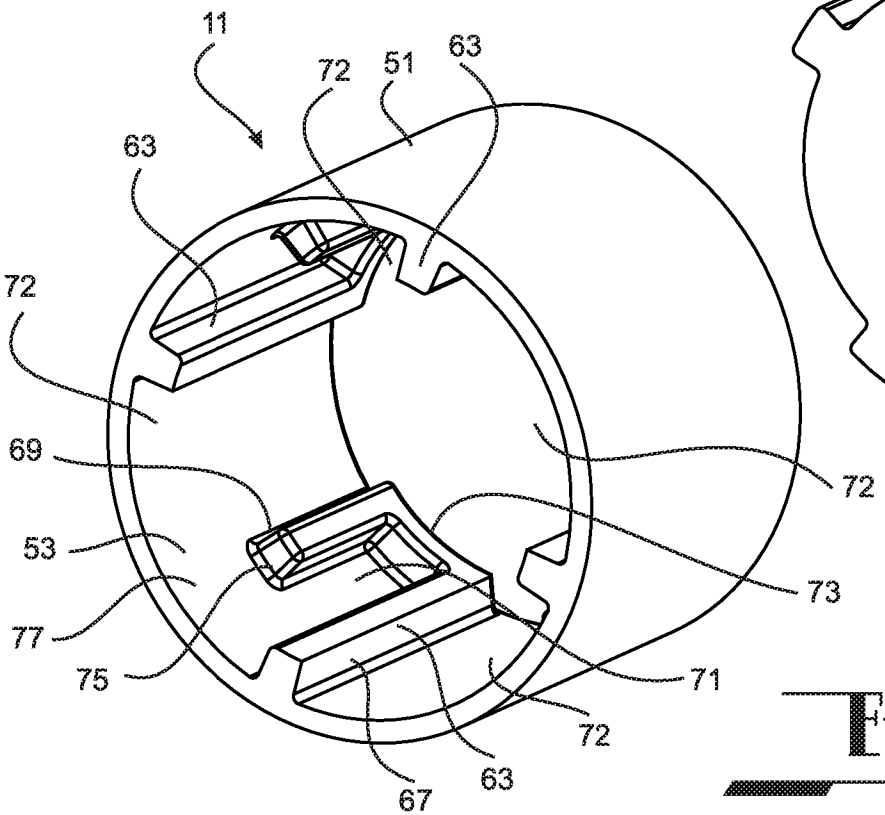
FIG. 11 is a fragmentary perspective view of part of the drive collar.

The splines 43 are each configured as two spline sections, being a first spline section 47 adjacent the shank 19 and a second spline section 49 adjacent the cutting face 15. The two spline sections 47, 49 are circumferentially offset, as best seen in FIGS. 1 and 10.

Figure 3:
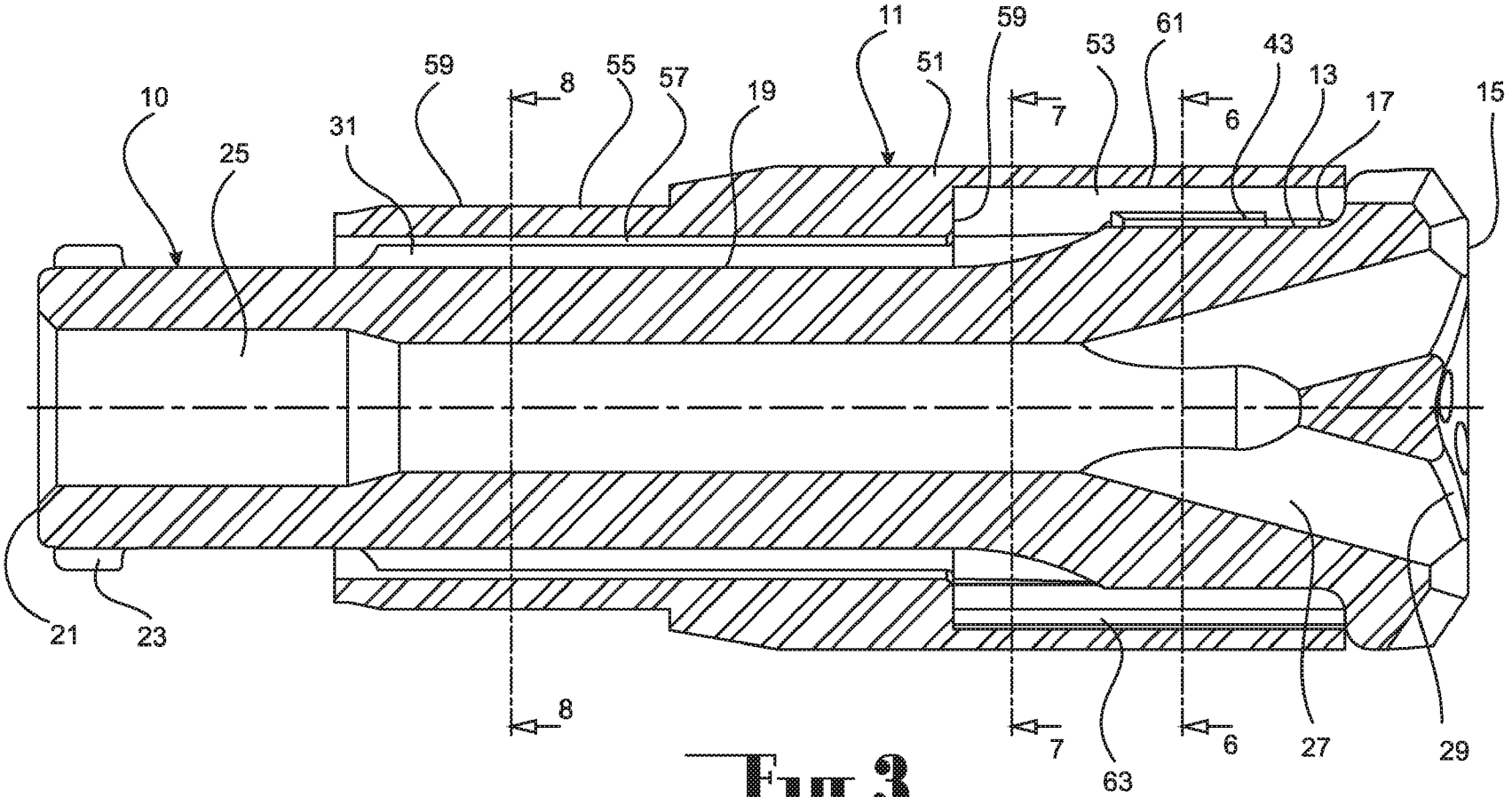
FIG. 3 is a longitudinal sectional view of an assembly comprising the drill bit of FIG. 1 retained within the drive sub of FIG. 2.

The drive collar 11 comprises a first portion 51 and a second portion 55 integrated therewith. The first portion 51 defines a central cavity 53 for receiving the drill bit head 13 and the second portion 55 defines a further central cavity 57 for receiving the shank 19, as best seen in FIG. 3 of the drawings. The first portion 51 has an open end 52 opening onto the central cavity 53 and a shoulder 59 defined between the two cavities 53, 57. The second portion 55 has a threaded section 59 for engagement with the barrel (not shown) of the percussive hammer.

The first section 51 has a circumferential wall 61 which defines the cavity 53. The circumferential wall 61 supports splines 63 for mating engagement with the splines 43 on the drill bit 10. In particular, each spline 43 is in counterpart relation with one of the spline section 63, as will be explained in more detail later.

Figure 2:
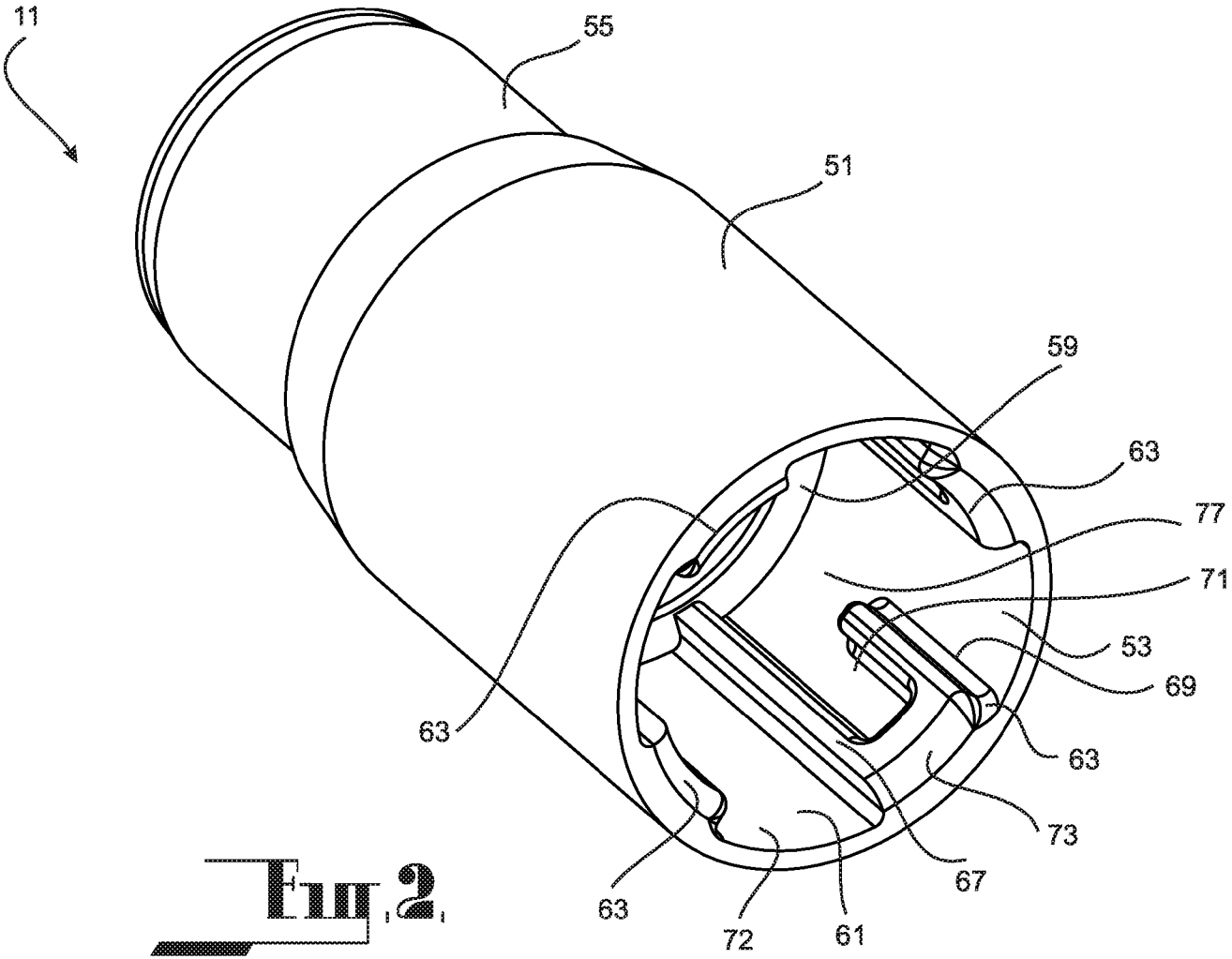
FIG. 2 is a perspective view of a drive collar of the down-hole hammer according to the first embodiment.

The splines 63 are each configured as two spline sections, being a first spline section 67 and a second spline section 69. The two spline sections 67, 69 are circumferentially offset to define a retention gap 71 therebetween, as best seen in FIGS. 2 and 10. The retention gap 71 is configured and dimensioned to receive the first spline section 47 of the counterpart spline 43 on the drill bit 10, as will also be explained in more detail later. The two spline sections 67, 69 are interconnected at adjacent ends by a circumferential web 73 which closes one end of the retention gap 71.

The first spline section 67 extends from the web 73 to the shoulder 59. The second spline section 69 extends from the web 73 and terminates at an end 75 spaced from the shoulder 59, thereby providing a clearance space 77 between the end 75 and the shoulder 59. The clearance space 77 is dimensioned to allow the first spline section 47 of the counterpart spline 43 on the drill bit 10 to pass therethrough upon relative rotation between the drill bit 10 and the drill sub 11.

Figure 4:
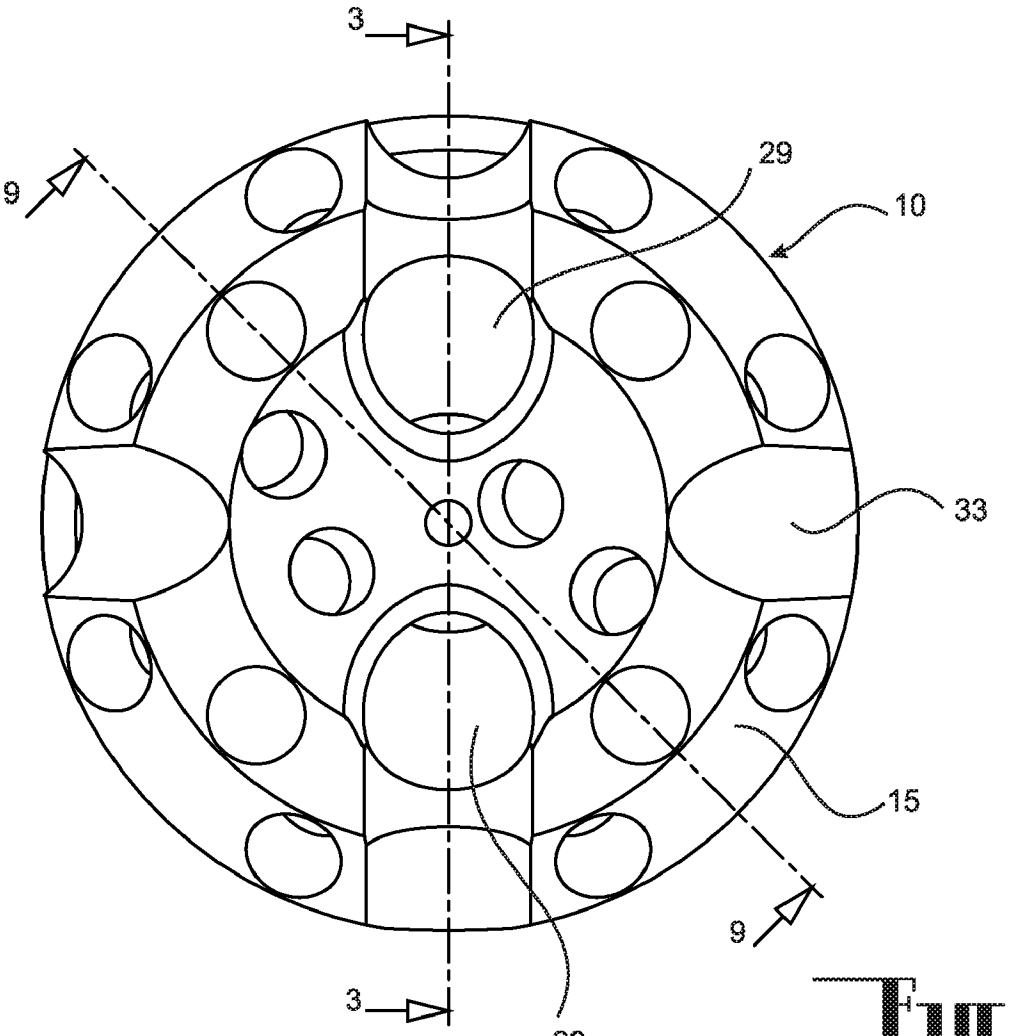
FIG. 4 is an elevational view at one end of the assembly shown in FIG. 3.
Figure 5:
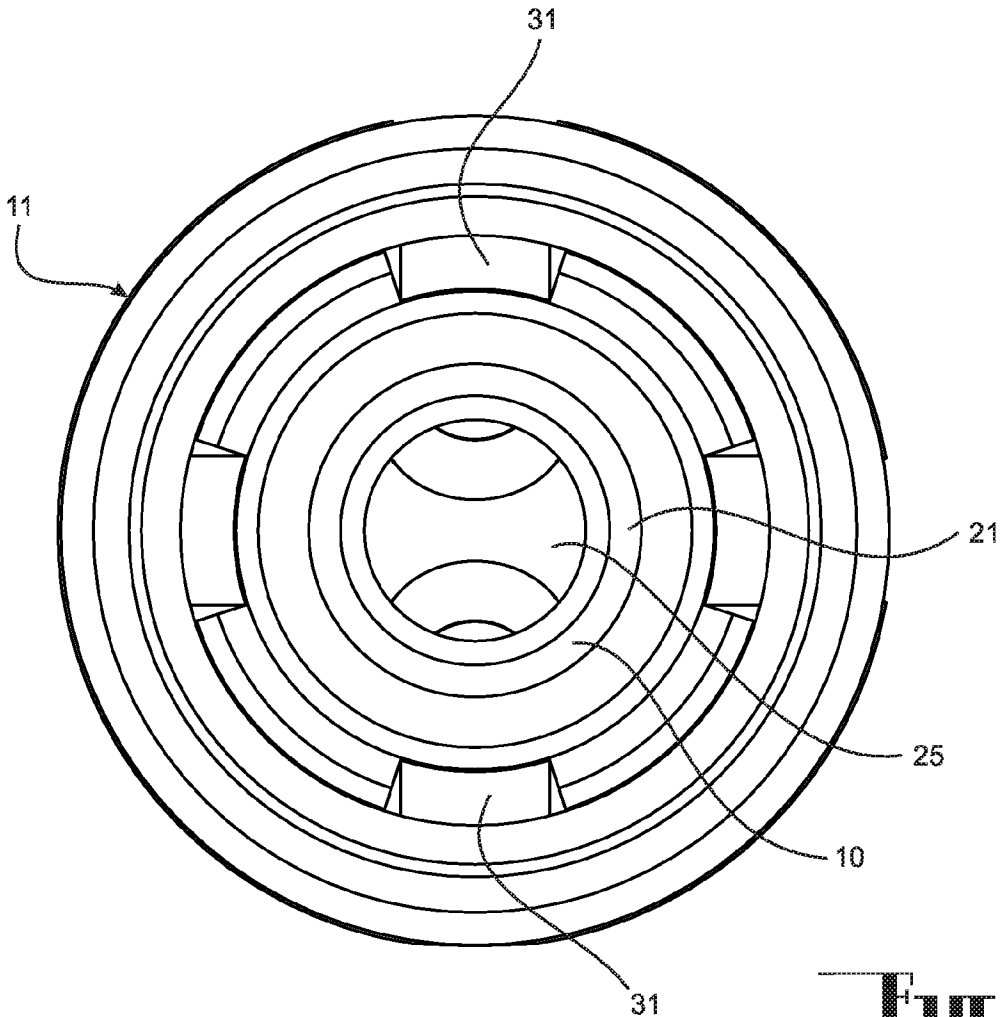
FIG. 5 is an elevational view at the other end of the assembly shown in FIG. 3.
Figure 6:
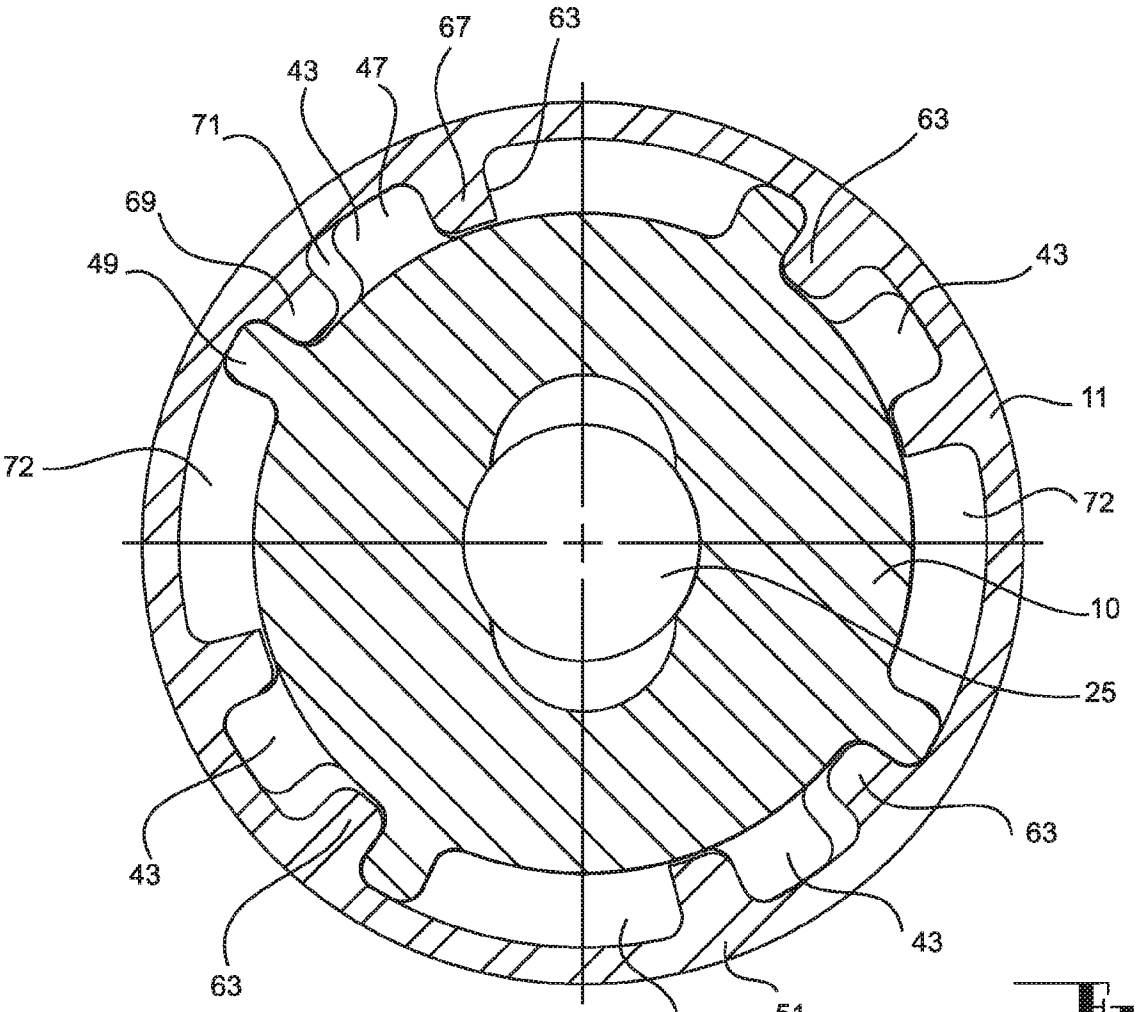
FIG. 6 is a cross-section on line 6-6 of FIG. 3.
Figure 7:
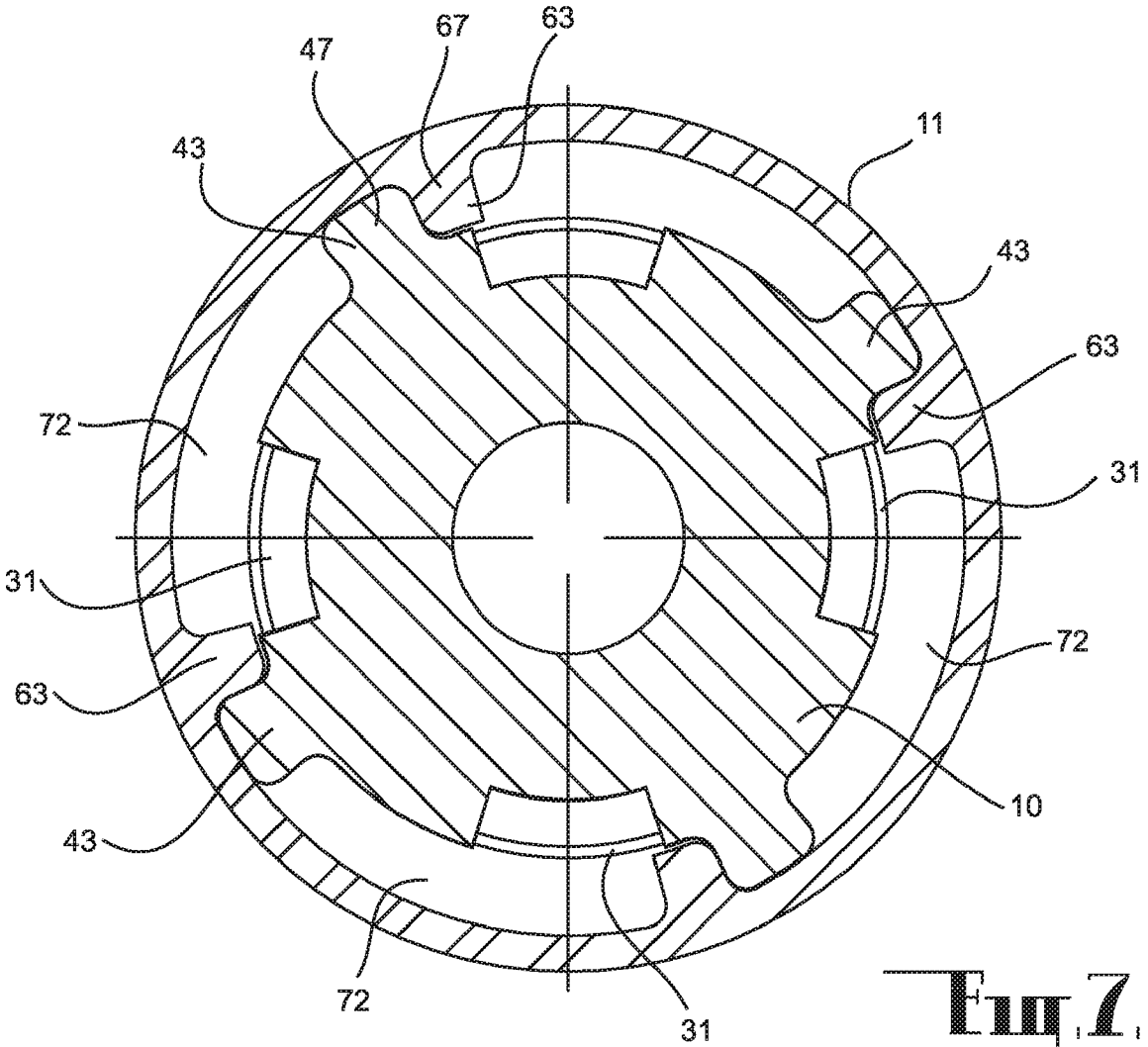
FIG. 7 is a cross-section on line 7-7 of FIG. 3.
Figure 8:
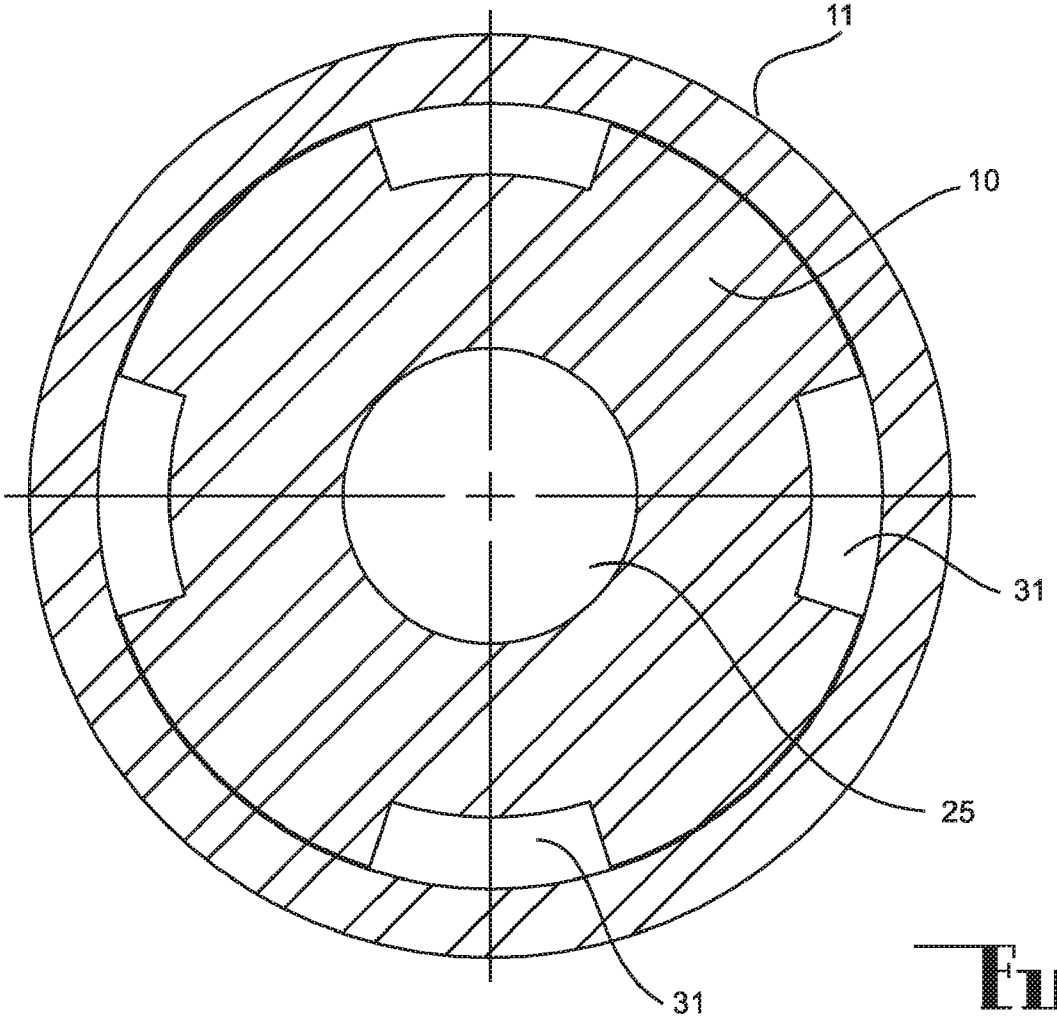
FIG. 8 is a cross-section on line 8-8 of FIG. 3.
Figure 9:
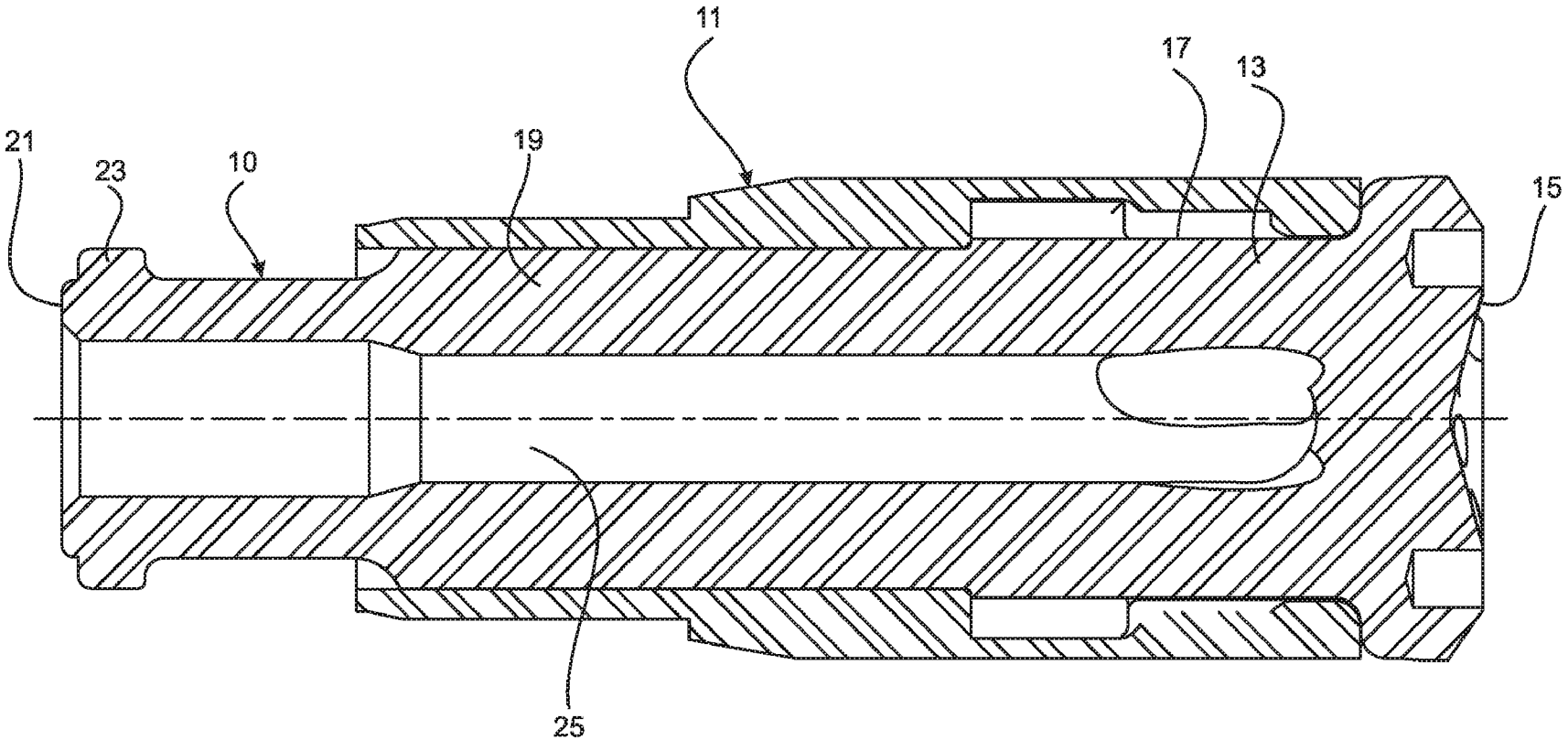
FIG. 9 is a further longitudinal sectional view of an assembly comprising the drill bit of FIG. 1 retained within the drive sub of FIG. 2.

Splines 43 on the drill bit 10 and the splines 63 on the drive collar 11 are so arranged that the drill bit 10 can be orientated with respect to the drive collar 11 such that each spline 43 can align with the circumferential spacing 72 between two splines 63 on the drive sub 11 and can also be accommodated therein upon axial movement of the drill bit into the drill sub. The extent to which the drill bit 10 can enter the drive sub 11 is limited by contact between the ends of the first split section 47 on the drill bit 10 with the shoulder 59 on the drive collar 11. At this stage, the drill bit 10 can be rotated relative to the drive sub 11 to move each first spline section 47 through the clearance space 77 associated with its counterpart spline 65 on the drive collar 11 until that first spline section 47 registers with the retention gap 71. Typically, this would correspond with the first spline section 47 abutting the first spline section 67 in the counterpart spline on the drive sub 11. The drill bit 10 can then be partly retracted to move the first spline section 47 into the retention gap 71. At this stage, the first spline section 67 is in driving engagement with the first spline section 47 and the second spline section 69 is in driving engagement with the second spline section 49, as best seen in FIG. 4 of the drawings.

With this arrangement, the webs 73 serve to retain the drill bit 10 in the drive collar 11. Further, the mating splines 43, 63 provide a drive coupling between the drive sub 11 and the drill bit 10 which allows rotation to be transferred from the drive sub to the drill bit while also allowing the drill bit to slide axially within the drive sub to an extent to perform its percussive action. The extent of axial movement of the drill bit 10 within the drive sub 11 is limited by interaction between the ends of the first splines 47 on the drill bit 10 and the web 73 adjacent one end thereof and the shoulder 59 adjacent the other end thereof.

With this arrangement, the mating splines 43, 63 provide an interconnection between the drill bit 10 and the drive sub 11. This arrangement provides a simple yet highly effective arrangement for transmitting drive to the drill bit 10 and also retaining the drill bit within the drill sub 11.

As will be apparent from the drawings, the contact faces of the splines 43, 63 are profiled for mating engagement.

Because the splines 43 are located on the drill head shoulder section 17, they are located away from the shank 19. In this way, rotational torque is delivered directly to the drill bit head 13 and does not rely on torque transfer through the shank 19 as is the case with prior art arrangements described previously.

Because the shank 19 does not carry the splines 43, it can be of reduced length compared to prior art arrangements. This is advantageous as it provides an opportunity to reduce the overall mass of the drill bit, facilitating energy transfer from the percussive hammer to the drill bit.

It will be noted that the retainer flange 23 is not utilised in retaining the drill bit in position.

Figure 12:
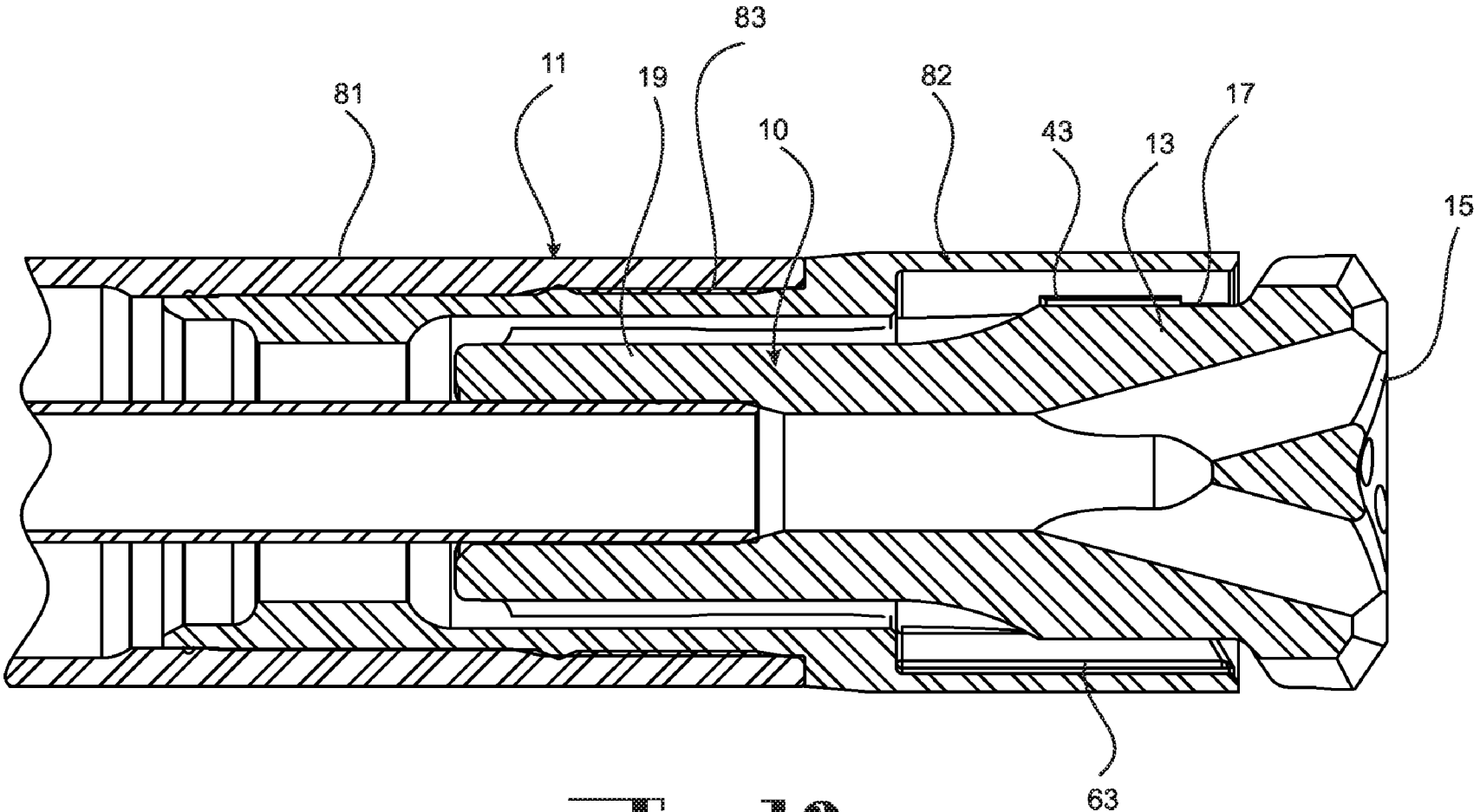
FIG. 12 is a fragmentary longitudinal sectional view of an assembly of a drill bit and a drive collar for a down-hole hammer according to a second embodiment.

Referring now to FIG. 12 of the drawings, there is shown a drill bit 10 and a drive sub 11 for a down-hole hammer according to a second embodiment. The down-hole hammer according the second embodiment is similar in many respects to the down-hole hammer according to the first embodiment and so corresponding reference numerals are used to identify corresponding parts.

In this embodiment, the shank 19 of the drill bit 10 does not incorporate a retainer flange, and consequently can be of even shorter length.

Further, in this embodiment, the drive collar 11 is of two-part construction, comprising a first portion 81 and a second portion 82, with the two portions adapted to be connected by threaded coupling 83.

Figure 13:
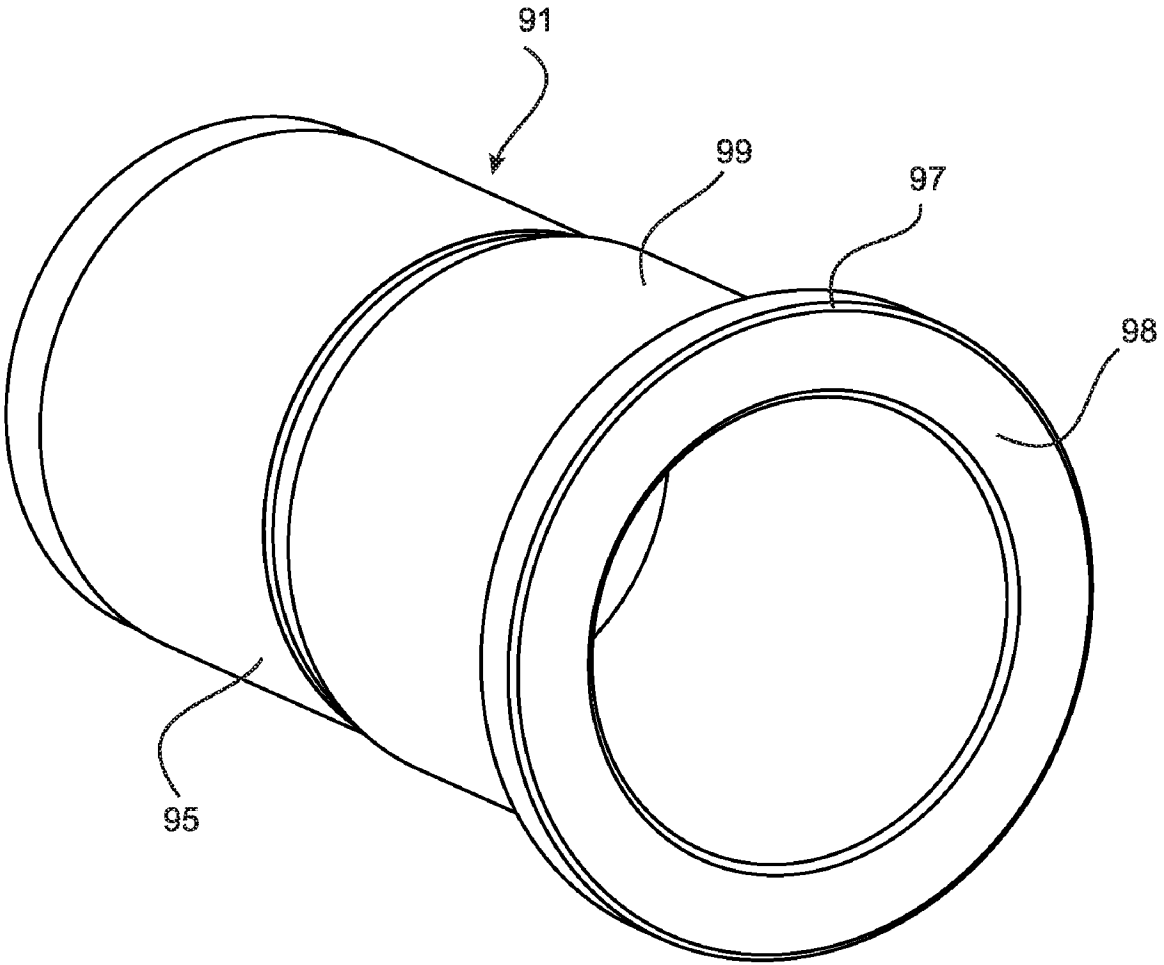
FIG. 13 is a perspective view of one part of a drive collar of a down-hole hammer according to a third embodiment.
Figure 14:
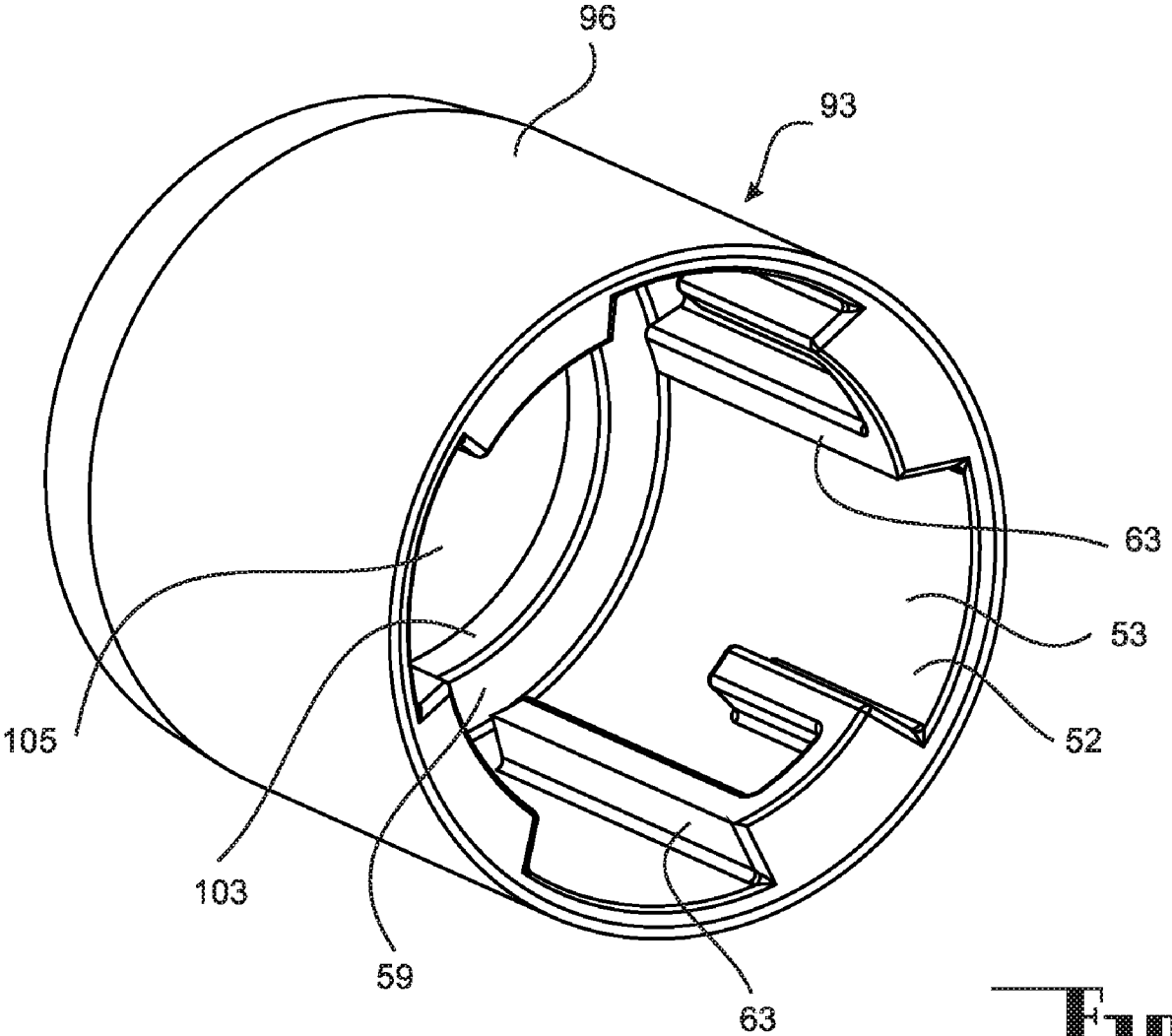
FIG. 14 is a perspective view of another part of a drive collar of the down-hole hammer according to a third embodiment.

Referring now to FIGS. 13 and 14, there is shown a drive collar for a down-hole hammer according to a third embodiment. The down-hole hammer according to the third embodiment is similar in many respects to the down-hole hammer according to the second embodiment and so corresponding reference numerals are used to identify corresponding parts.

In this embodiment, the second portion 82 of the drive sub 11 is itself of a two-part construction, comprising a base portion 91 as shown in FIG. 13 and a drive collar portion 93 as shown in FIG. 14.

The base portion 91 comprises a bottom sub comprising an annular body 95 having a mount 97 at one end 98 thereof and a threaded section 99 adjacent the mount. The threaded section 99 is adapted to engage the first portion 81 of the drive collar 11, in a similar manner to the arrangements shown in FIG. 12. The mount 97 provides an abutment against which the free end of the first portion 81 can locate when the base portion 91 is threadingly engaged with the first portion 81 of the drive collar 11.

The drive collar portion 93 comprises an annular body 96 which defines the central cavity 53 for receiving the drill bit head and incorporates the spline 63 for mating engagement with the splines 43 on the drill bit, as was the case with previous embodiments.

The inner end of the drive collar portion 93 incorporates a sleeve section 103 defining a central opening 105 which defines part of the central cavity 57. One face of the sleeve section 103 defines the shoulder 59 against which the drill bit head locates, as was the case with previous embodiments.

The sleeve section 103 of the drive collar portion 93 is adapted to be received on the mount 97 of the base portions 91 for frictional engagement therewith to couple the two parts together. The coupling between the drive collar portion 93 and the base portion 91 may incorporate an interconnection for drive transmission therebetween, the interconnection being of any appropriate form such as keying or castellations.

Forming the second portion 82 in two parts is advantageous, in that it allows the drive collar portion 93 to be replaced when worn or damaged without necessarily replacing the base portion 91. Further, it allows the drive collar portion 93 to be matched in terms of hardness to the driving conditions, if desired. Still further, the two-part construction may be easier to manufacture than the corresponding component of unitary construction.

Referring now to FIGS. 15 to 25, there is shown a drill bit 10 and a drive sub 11 for down-hole hammer according to a fourth embodiment. The down-hole hammer according to the fourth embodiment is similar in many respects to the down-hole hammer according to the third embodiment and so correspondence reference numerals are used to identify corresponding parts.

In this embodiment, the second portion 82 of the drive sub 11 is also of two-part construction, comprising of base portion 91 and a drive collar portion 93, with the two portions 91, 93 adapted to be releasably interconnected by a detachable coupling system 94.

The base portion 91 comprises an annular body 95 having a mount 97 at one end 98 thereof and a threaded section 99 adjacent the mount. The threaded section 99 is adapted to engage the first portion 81 of the drill sub 11 in a similar manner to the arrangement shown in the previous embodiment.

The drive collar portion 93 comprises the annular body 96 which defines the central cavity 53 for receiving the drill bit head 13 and incorporates the spline 63 for mating engagement with the splines 43 on the drill bit 10, as was the case with previous embodiments. One end 111 of the annular body 96 to provide the open end 52. The other end 113 of the annular body 96 is also open and is configured to receive the end 98 of the base portion 91 to facilitate the detachable connection between the two portions 91, 93.

The coupling system 94 is configured as a bayonet connector comprising a spigot portion 115 defined by the end 98 of the base portion 91 and a socket portion 117 defined by the annual body 96 adjacent the open end 113.

The spigot portion 115 comprises a plurality radially spaced lugs 121 which define the mount 97 and which are adapted to cooperate with mating elements 123 on the inner wall of the annular body 96 adjacent the open end 113. The mating elements 123 thus form part of the socket portion 117.

Each lug 121 has two ends 122, 124, an inner face 126 and an outer face 128.

The mating elements 123 are circumferentially spaced, with the spacing between adjacent elements defining gaps 125 dimensioned to permit the lugs 121 to pass therethrough. Each mating element 123 comprises an inner face 131 and a stop 133 at one end of the inner face 131 against which one of the lugs 121 may locate.

Figure 23:
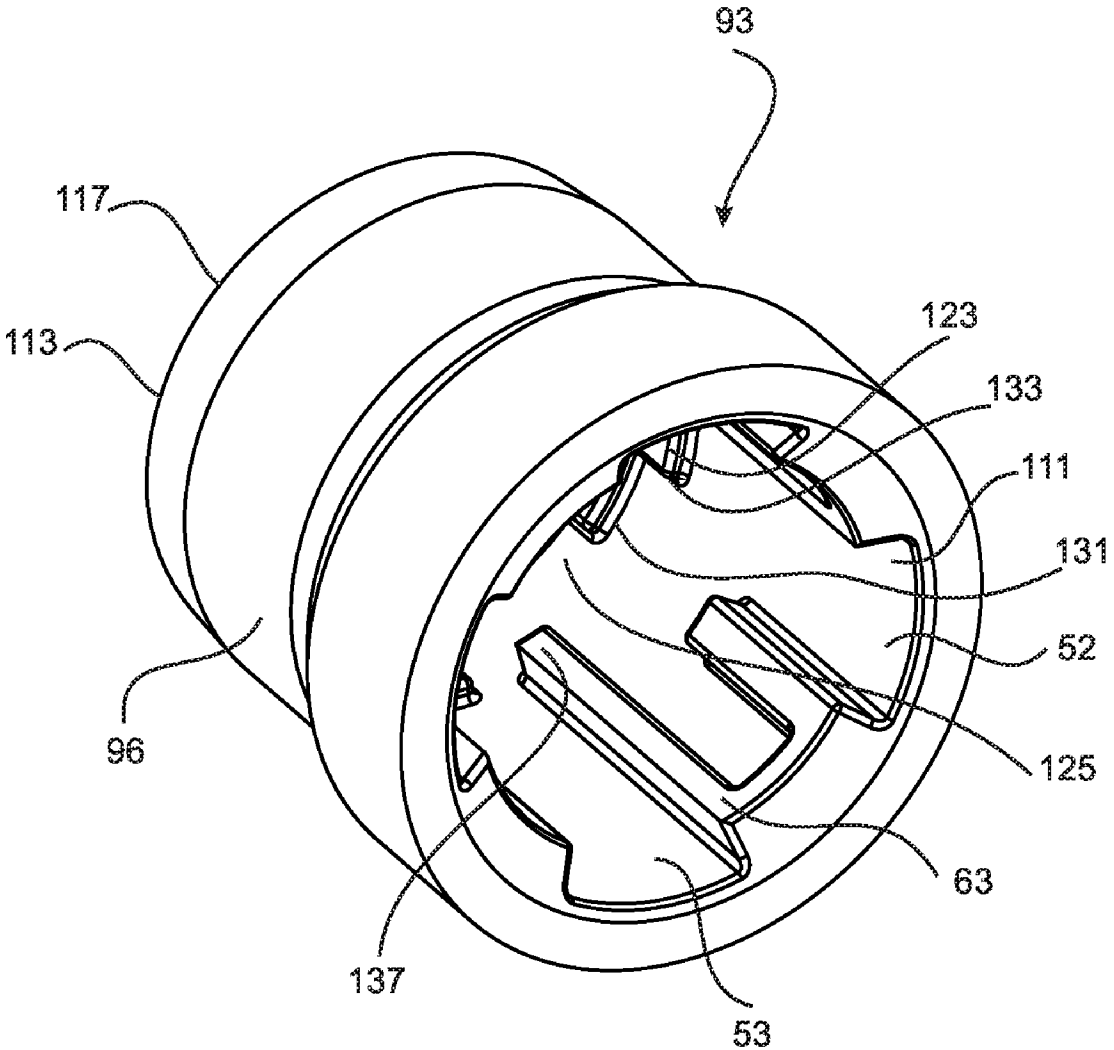
FIG. 23 is a perspective view of a drive collar portion of a drive sub of the down-hole hammer according to the fourth embodiment.
Figure 24:
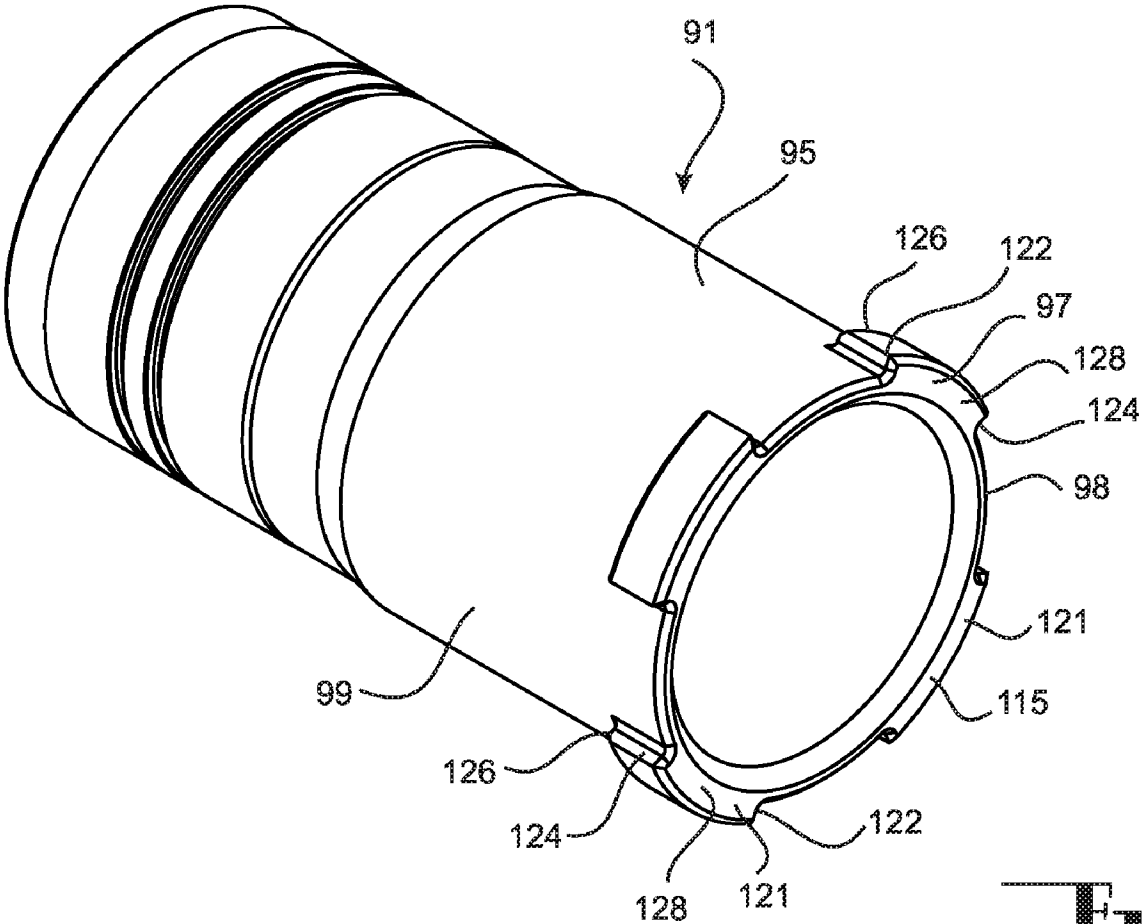
FIG. 24 is a perspective view of a base portion of a drive sub of the down-hole hammer according to the fourth embodiment.
Figure 25:
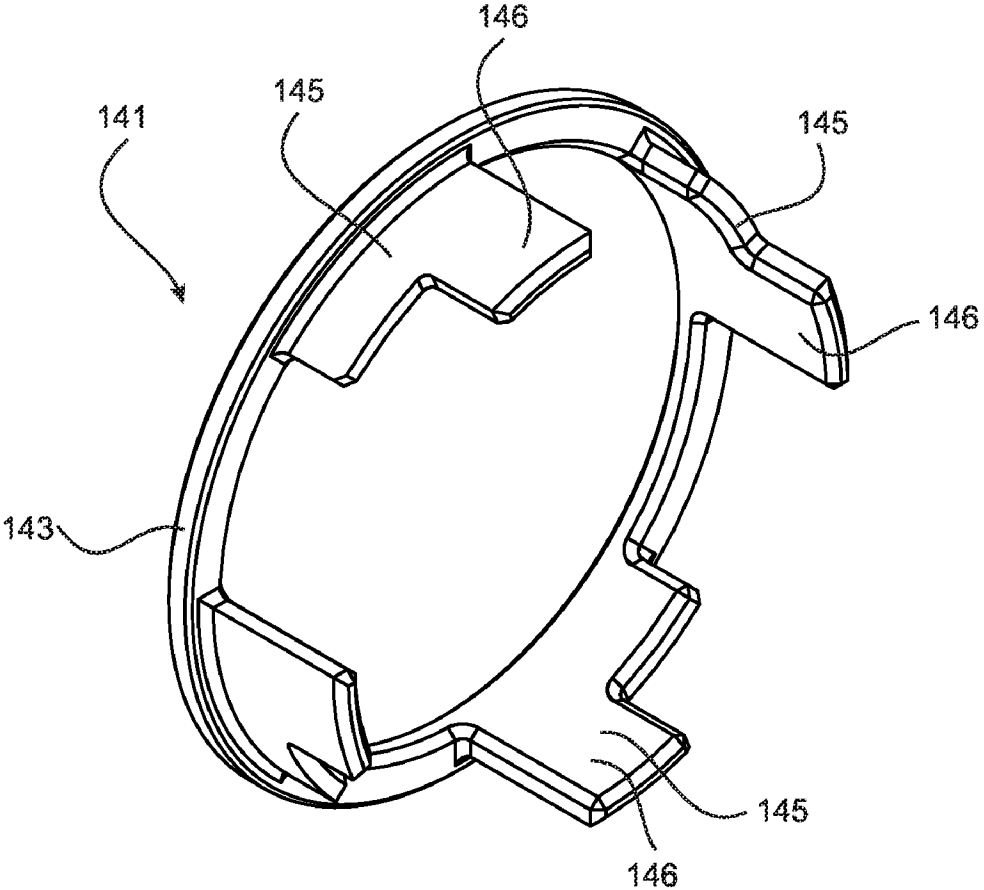
FIG. 25 is a perspective view of a retainer for retaining the drive collar portion and the base portion together.

With this arrangement, the spigot portion 115 can be introduced into the socket portion 117 with the lugs 121 passing though the gaps 125. The extent of inward movement of the spigot portion 115 with respect to the socket portion 117 is limited by the inner end 137 of each support spline 63, as seen in FIG. 23. Once the spigot portion 115 has been fully inserted into the socket portion 117, the base portion 91 can be rotated relative to the drive collar portion 93 to move the lugs 121 into engagement with the mating elements 123, with the inner face 126 of each lug engaging the inner face 131 of the respective mating element 123 and the leading end 122 of each lug abutting the stop 133. With this arrangement, the spigot portion 115 is retained within the socket portion 117.

A retainer 141 is provided for installation between the spigot portion 115 and the socket portion 117 to prevent rotation of the spigot portion 115 in the reverse direction and separation of the two portions.

The retainer 141 comprises an annular base 143 and a plurality of tabs 145 protecting therefrom. The tabs 145 are adapted to extend through the gap 125 between adjacent mating elements 123, with a portion 146 of each tab locating in the space between end 124 of the respective lug 121 and an adjacent mating element 123 thereby to block the lug against rotation.

The annular base 143 is fitted onto the base portion 91 and moved therealong to present the tabs 145 to the gaps 125 to releasably secure the two portions 91, 93 together. When it is desired to separate the two potions 91, 93, the retainer 141 is merely extracted from the gaps 125 to thereby allow spigot portion 115 to be rotated in the reverse direction for separation from the socket portion 117.

Figure 15:
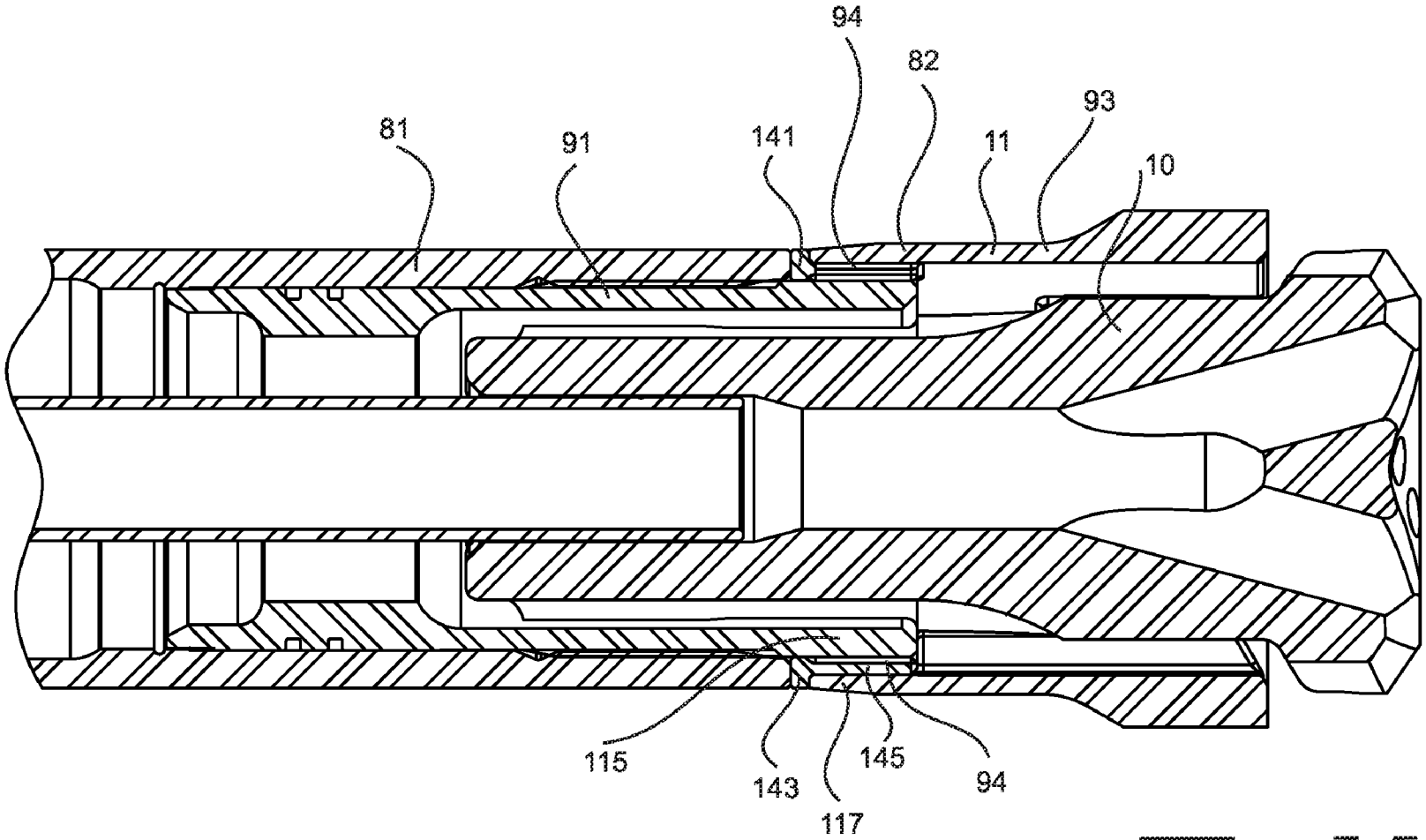
FIG. 15 is a fragmentary sectional view of a down-hole hammer according to a fourth embodiment.
Figures 16, 17, 18, 19, 20, 21:
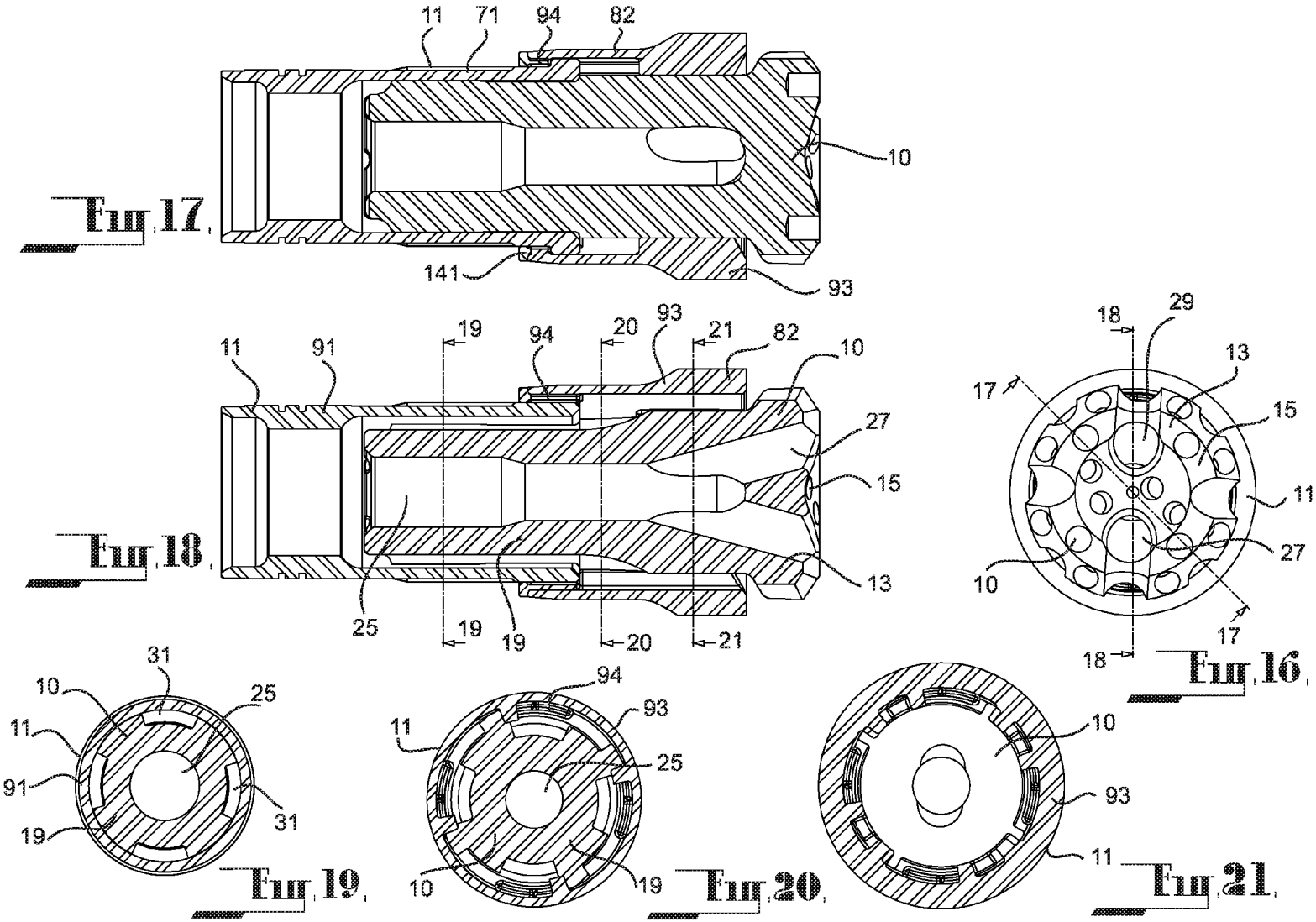
FIG. 16 is an end view of the down-hole hammer of FIG. 15.
FIG. 17 is a longitudinal section view on line 17-17 of FIG. 16.
FIG. 18 is a longitudinal sectional view on line 18-18 of FIG. 16.
FIG. 19 is a cross-section on line 19-19 of FIG. 18.
FIG. 20 is a cross-section on line 20-20 of FIG. 18.
FIG. 21 is a cross-section on line 21-21 of FIG. 18.
Figure 22:
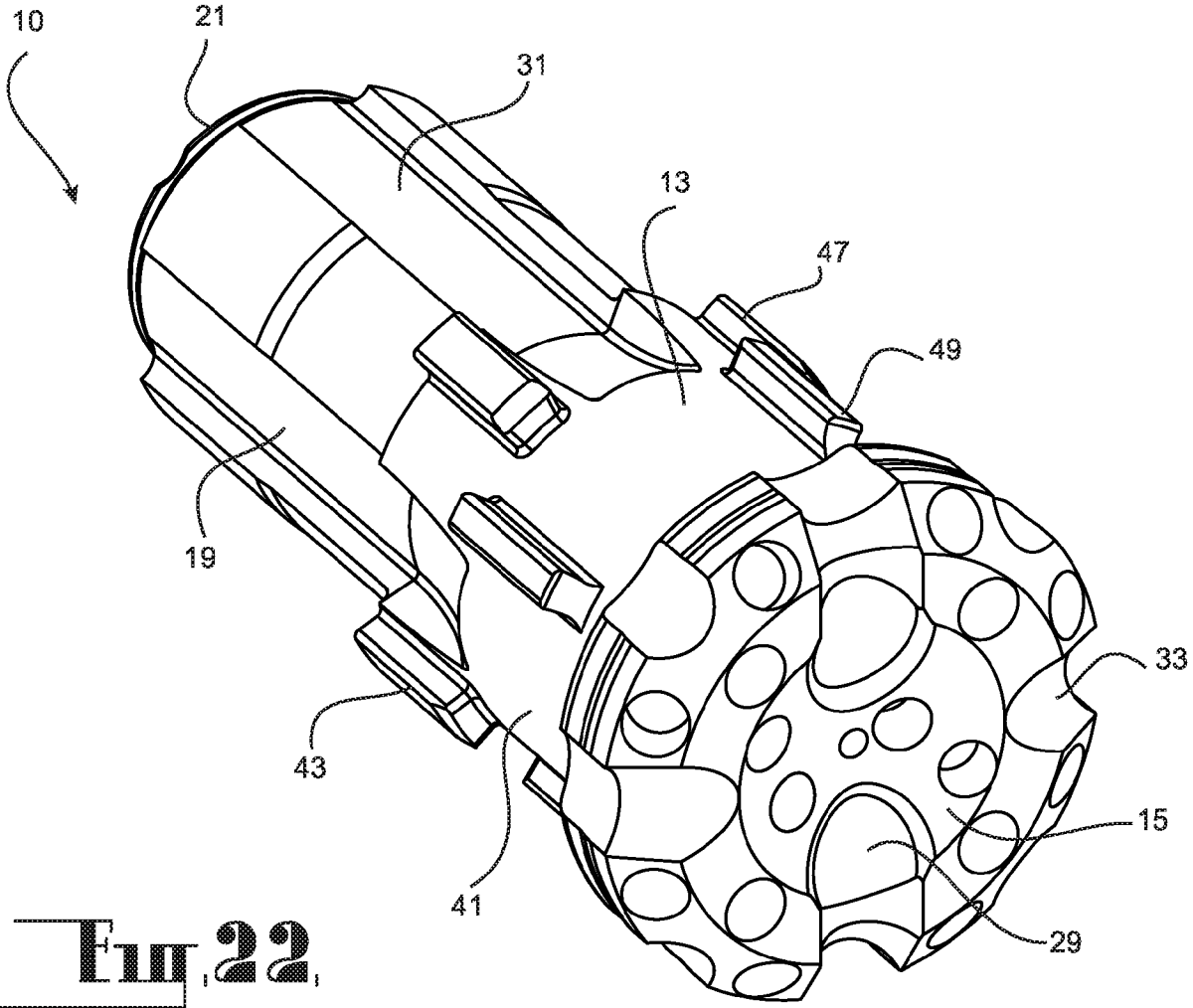
FIG. 22 is a perspective view of the drill bit for the drill bit hammer according to the fourth embodiment.

In use, the retainer 141 is held in place between the spigot portion 115 and the socket portion 117 by the first portion 81 of the drill sub, as shown in FIG. 15.

Referring now to FIGS. 26 to 36, there is shown a drill bit 10 and a drive sub 11 for a down-hole hammer according to a fifth embodiment. The down-hole hammer according to the fifth embodiment is similar in many respects to the down-hole hammer according to the fourth embodiment and so corresponding reference numerals are used to identify corresponding parts.

In this embodiment, the second portion 82 of the drive sub 11 is also of two-part construction, comprising of a base portion 91 and a drive collar portion 93, with the two portions 91, 93 adapted to be releasably interconnected by a detachable coupling system 94.

The base portion 91 comprises an annular body 95 having a mount 97 at one end 98 thereof and a threaded section 99 adjacent the mount. The threaded section 99 is adapted to engage the first portion 81 of the drill sub 11 in a similar manner to the arrangement shown in the previous embodiment.

The drive collar portion 93 comprises the annular body 96 which defines the central cavity 53 for receiving the drill bit head 13 and incorporates the splines 147 for mating engagement with the splines 148 on the drill bit 10, as was the case with previous embodiments.

Figure 27:
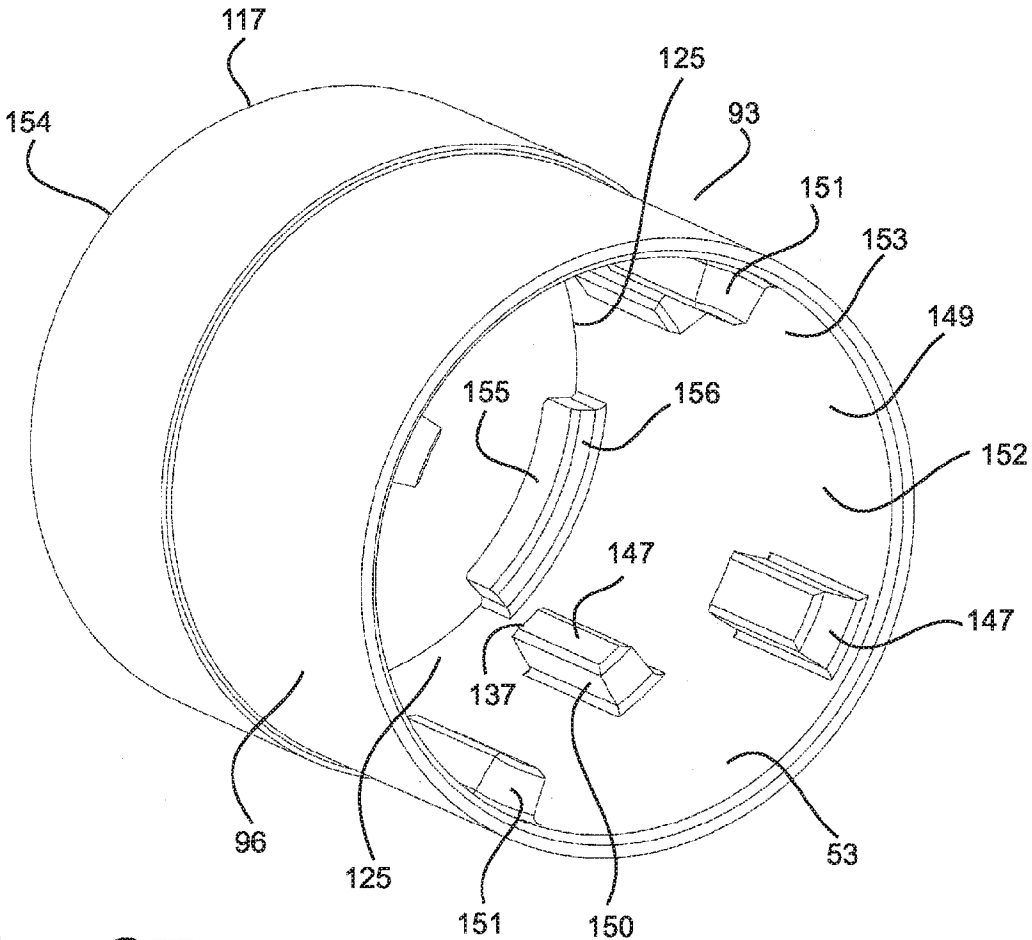
FIG. 27 is a perspective view of a drive collar portion of a drive sub of the down-hole hammer according to the fifth embodiment.
Figure 28:
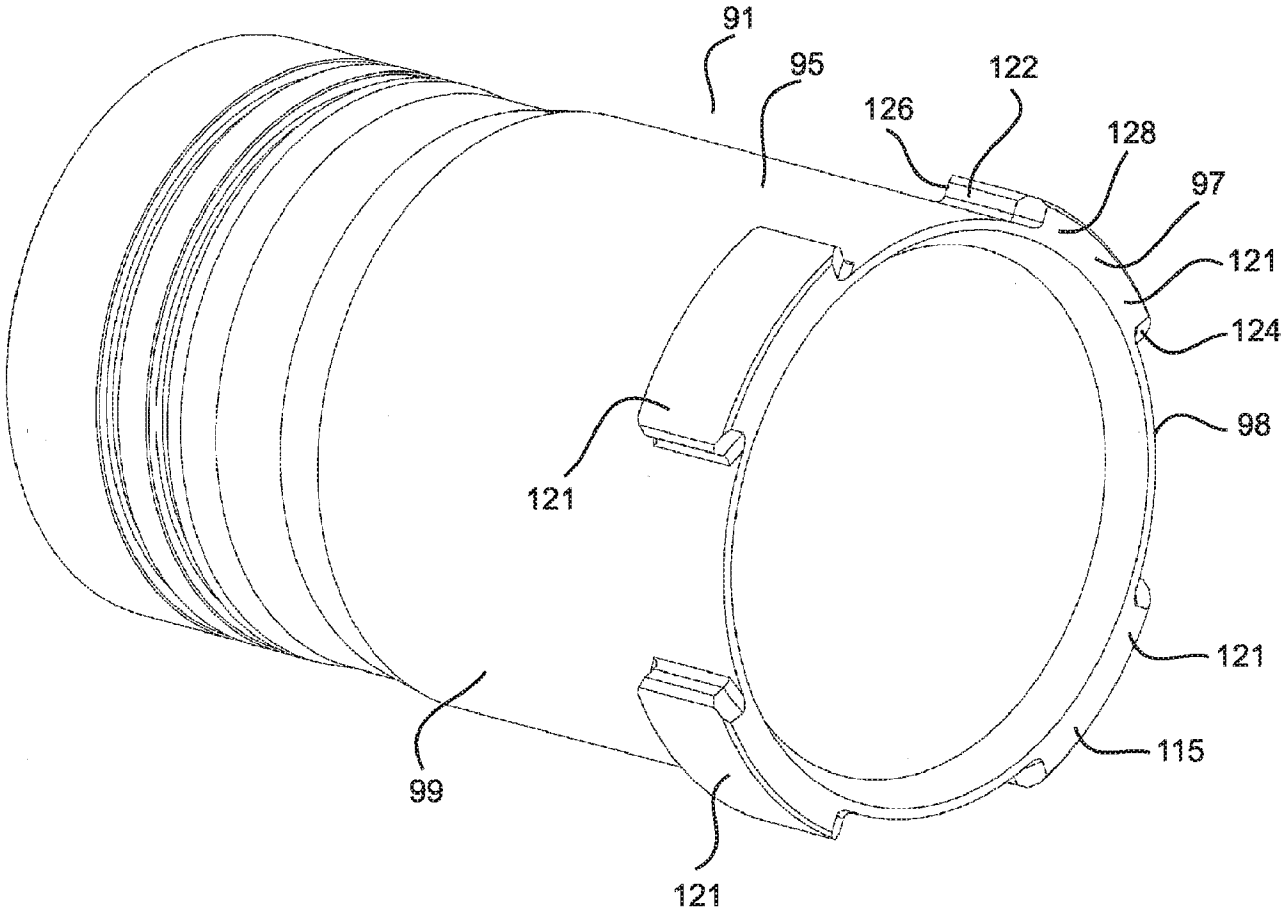
FIG. 28 is a perspective view of a base portion of a drive sub of the down-hole hammer according to the fifth embodiment.
Figure 29:
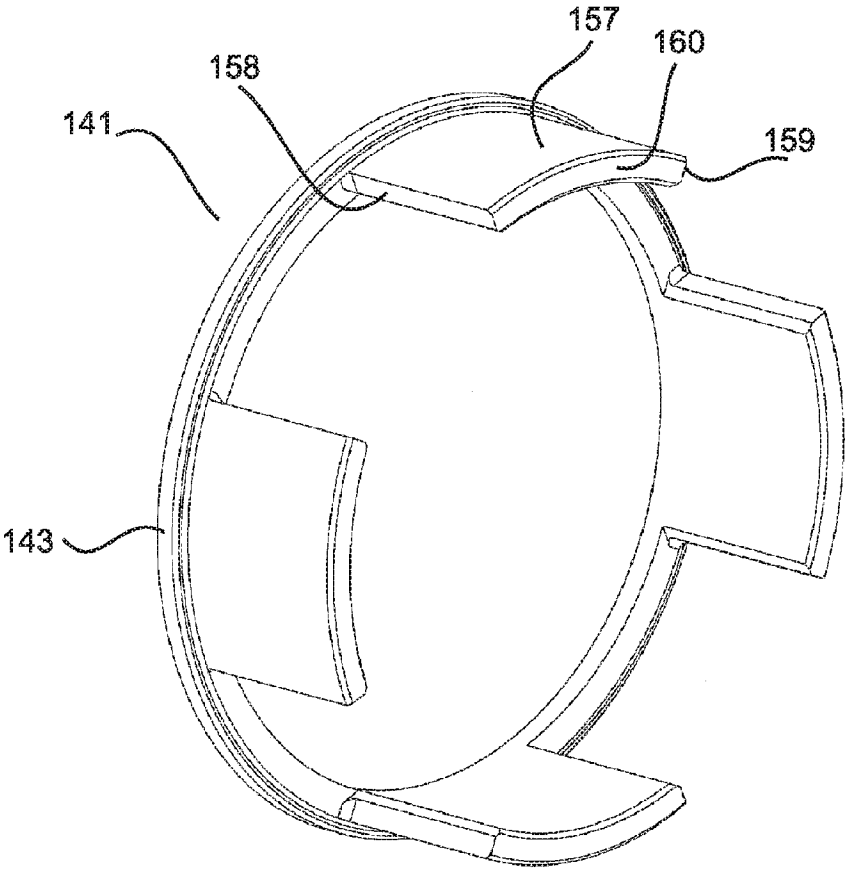
FIG. 29 is a perspective view of a retainer for retaining the drive collar portion and the base portion together shown in FIGS. 26 to 28.
Figures 30, 31, 32, 33, 34, 35, 36:
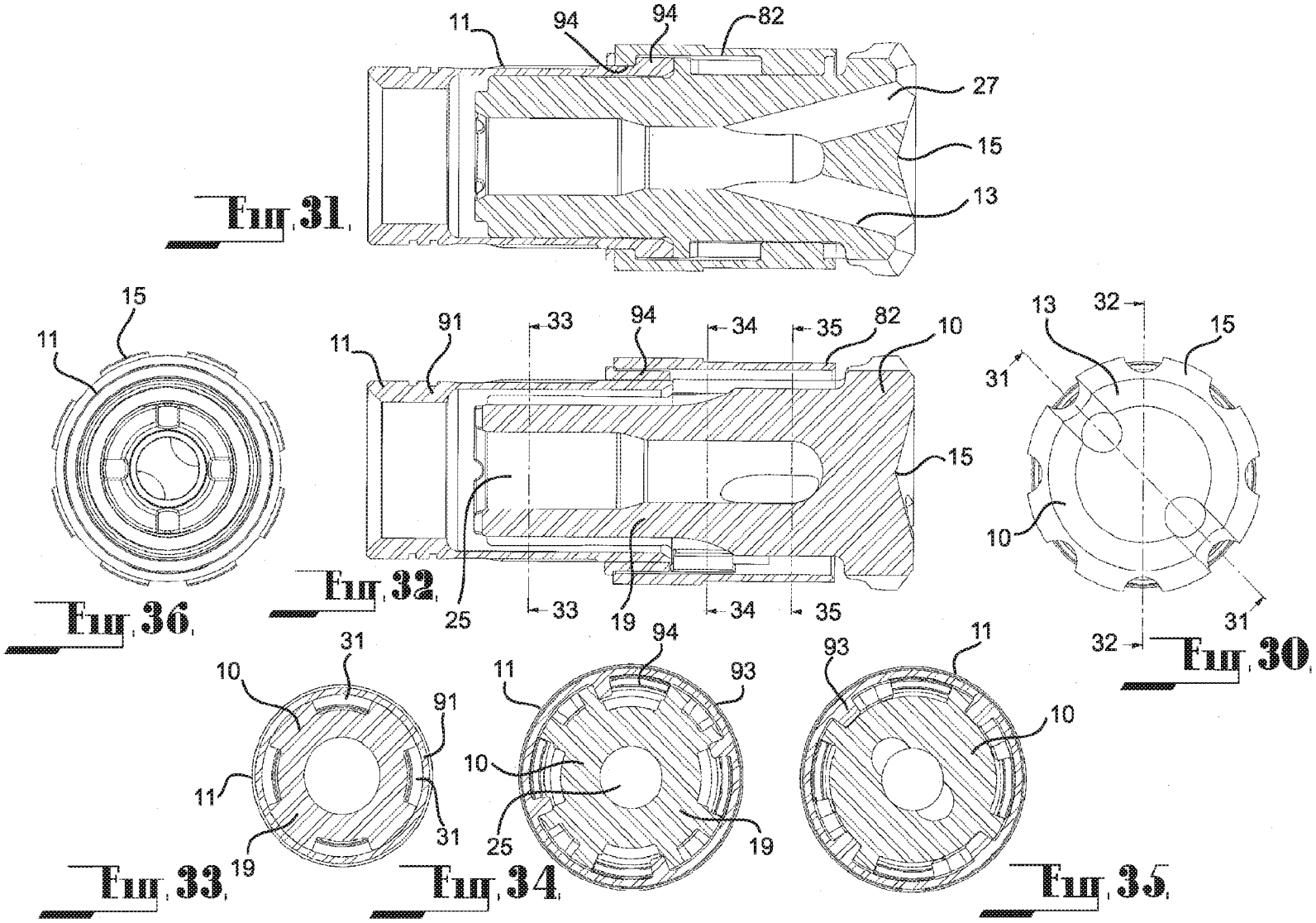
FIG. 30 is an end view of the down-hole hammer including the drill bit according to the fifth embodiment.
FIG. 31 is a longitudinal section view on line 31-31 of FIG. 30.
FIG. 32 is a longitudinal sectional view on line 32-32 of FIG. 30.
FIG. 33 is a cross-section on line 33-33 of FIG. 32.
FIG. 34 is a cross-section on line 34-34 of FIG. 32.
FIG. 35 is a cross-section on line 35-35 of FIG. 32.
FIG. 36 is the opposite end view (with respect to FIG. 30) of the down-hole hammer including the drill bit according to the fifth embodiment.

As shown in FIG. 27, the central cavity 53 defines a circumferential inner surface 149 on which splines 147 are provided.

The splines 147 are each configured as two spline sections. A first spline section 150 centrally located on the circumferential inner surface 149 within the central cavity 53. A second spline section 151 is located adjacent open end 152 which receives the drill bit head 13. The two spline sections 150, 151 are circumferentially offset, as best seen in FIG. 27.

One end 153 of the annular body 96 is open thus providing the open end 152. The other end 154 of the annular body 96 is also open and is configured to receive the end 98 of the base portion 91 to facilitate the detachable connection between the two portions 91, 93.

The coupling system 94 is configured as a bayonet connector comprising a spigot portion 115 defined by the end 98 of the base portion 91 and a socket portion 117 defined by the annual body 96 adjacent the open end 154.

The spigot portion 115 comprises a plurality radially spaced lugs 121 which define the mount 97 and which are adapted to cooperate with mating elements 155 on the circumferential inner surface of the drive collar 11. The mating elements 155 thus form part of the socket portion 117.

Each lug 121 has two ends 122, 124, an inner face 126 and an outer face 128.

The mating elements 155 are circumferentially spaced, with the spacing between adjacent elements defining gaps 125 dimensioned to permit the lugs 121 to pass therethrough. Each mating element 155 comprises an inner face 156. When the base portion 91 and the drive collar portion 93 are joined together the inner faces 126 of each of the lugs 121 contact the inner faces 156 of the mating elements 155.

With this arrangement, the spigot portion 115 can be introduced into the socket portion 117 with the lugs 121 passing though the gaps 125. The extent of inward movement of the spigot portion 115 with respect to the socket portion 117 is limited by the first spline section 150. Once the spigot portion 115 has been fully inserted into the socket portion 117, the base portion 91 can be rotated relative to the drive collar portion 93 to move the lugs 121 into engagement with the mating elements 155, with the inner face 126 of each lug engaging the inner face 156 of the respective mating element 155. With this arrangement, the spigot portion 115 is retained within the socket portion 117.

A retainer 141 (see FIG. 29) is provided for installation between the spigot portion 115 and the socket portion 117 to prevent rotation of the spigot portion 115 in the reverse direction and separation of the two portions.

The retainer 141 comprises an annular base 143 and a plurality of tabs 157 protecting therefrom. Each tab 157 comprises side faces 158 and 159 and an end face 160.

The tabs 157 are adapted to extend through the gap 125 between adjacent mating elements 155. The side faces 158 and 159 of each tab 157 fit between two neighbouring mating elements 155 and neighbouring lugs 121 of the spigot portion 115 thereby blocking the lugs 121 against rotation.

The annular base 143 is fitted onto the base portion 91 and moved therealong to present the tabs 157 to the gaps 125 to releasably secure the two portions 91, 93 together. When it is desired to separate the two potions 91, 93, the retainer 141 is merely extracted from the gaps 125 to thereby allow spigot portion 115 to be rotated in the reverse direction for separation from the socket portion 117.

In use, the retainer 141 is held in place between the spigot portion 115 and the socket portion 117 by the first portion 81 of the drill sub, as shown in FIG. 15.

The drill bit 10 according to the fifth embodiment is similar in many respects to the down-hole hammer according to the previous embodiments and so corresponding reference numerals are used to identify corresponding parts.

Figure 26:
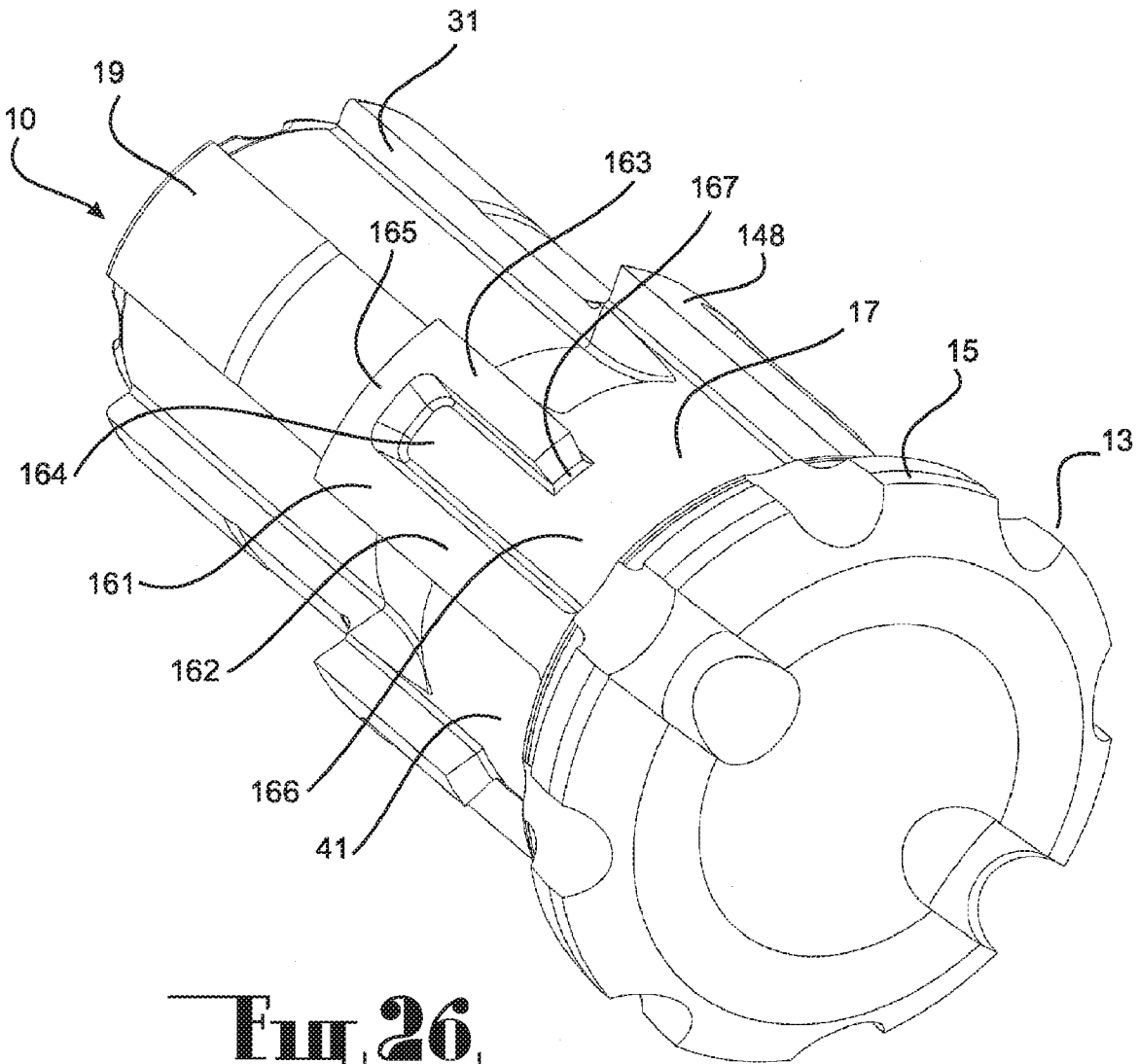
FIG. 26 is a perspective view of the drill bit for the drill bit hammer according to the fifth embodiment.

Referring to FIG. 26, the drill bit 10 according to the fifth embodiment comprises a shoulder section 17. The shoulder section 17 defines a circumferential face 41 on which splines 161 for mating engagement with the splines 151 of the drive collar 11. In particular, each spline 161 is in counterpart relation with one of the splines 151 of the drive collar 11 as has been previously explained with respect to the first embodiment of the invention.

The splines 161 are each configured as two spline sections, being a first spline section 162 and a second spline section 163. The two spline sections 162, 163 are circumferentially offset to define a retention gap 164 therebetween, as best seen in FIG. 26. The retention gap 164 is configured and dimensioned to receive the second spline section 151 of the drive collar 11.

The two spline sections 162, 163 are interconnected at adjacent ends by a circumferential web 165 which closes one end of the retention gap 164.

The first spline section 162 extends from the web 165 to the cutting face 15 of the drill bit 10. The second spline section 163 extends from the web 165 and terminates at a location 167 spaced from the cutting face 15, thereby providing a clearance space 166 between the location 167 and the cutting face 15. The clearance space 166 is dimensioned to allow the second spline section 151 of the drive collar 11 to pass therethrough upon relative rotation between the drill bit 10 and the drive collar 11.

From the foregoing, it is evident that the embodiments each provide a simple yet highly effective assembly between the drill bit and the drive collar, allowing the drill bit to be accommodated in the drive collar in a manner which reduces energy loadings on the shank whilst still effectively delivering rotational torque to the drill bit.

It should be appreciated that the scope of the invention is not limited to the scope of the various embodiments described. In another embodiment, for example, the drive coupling between the circumferential shoulder section on the drill bit head and the drive collar may utilise a conventional spline arrangement (or indeed any other appropriate form of drive coupling) and need not necessarily be configured to retain the drill bit in the drive collar. With such an arrangement, a conventional retaining mechanism incorporating a retaining flange on the shank of the drill bit could be used for the purposes of retaining the drill bit in position.

Further, the spline assemblies of the drill bit 10 and drive collar 11 of the first to fourth embodiments may comprise the spline arrangement of the fifth embodiments. In other words, the shoulder 17 of the drill bit 10 may comprise the splines 148 of the fifth embodiment (see FIG. 26) and the drive collar 11 of the first to fourth embodiment may comprise the splines 147 of the fifth embodiment (see FIG. 27).

Also, in other arrangements of the first to fourth embodiments the splines 43 of the drill bit 10 and the splines 63 of the drive collar 11 may be interchanged. In other words, the shoulder 17 of the drill bit 10 may comprise the splines 63 drive collar 11 of the first to fourth embodiment (see FIG. 2) and the drive collar 11 of the first to fourth embodiment may comprise the splines 43 of the drill bit 10 of the first to fourth embodiment (see FIG. 1).

While the invention has been described in relation to embodiments in the form of reverse circulation down-hole hammers, it should be understood that the invention need not be limited thereto and can be applied to other down-hole hammers (specifically, down-hole hammers using a conventional circulation system).

Modifications and variations can be made without departing from the scope of the invention.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The claims defining the invention is as follows:

1. A down-hole hammer comprising a drill bit and a drive means for rotating the drill bit, the drill bit comprising a drill bit head and a shank, the drill bit head comprising a cutting face and-a circumferential face adjacent the cutting face, the shank extending from the drill bit head in the direction away from the cutting face, the drive means comprising a spline assembly comprising two spline sections circumferentially offset on the circumferential face of the drill bit head for mating engagement with at least one counterpart spline on a surrounding part of the drive means to provide a drive coupling therebetween.

2. The down-hole hammer according to claim 1 wherein there are plurality splines on the circumferential face of the drill bit head for mating engagement in counterpart relation with splines on a surrounding part of the drive means.

3. The down-hole hammer according to claim 1 wherein the splines are adapted to interlock when in mating engagement to releasably retain the drill bit in position with respect to the drive means.

4. The down-hole hammer according to claim 1 wherein the drive means comprises a drive collar.

5. The down-hole hammer according to claim 4 wherein the drive collar comprises a first portion and a second portion, with the two portions adapted to be detachably interconnected.

6. The down-hole hammer according to claim 5 wherein the second portion of the drive collar comprises a base portion and a drive collar portion, with the base portion and the drive collar portion adapted to be detachably interconnected.

7. The down-hole hammer according to claim 6 further comprising a coupling system for detachably interconnecting the base portion and the drive collar portion.

8. The down-hole hammer according to claim 1 wherein the at least one counterpart spline comprises two spline sections circumferentially offset with respect to each other.

9. The down-hole hammer according to claim 8 wherein the spline sections on one part define a retention gap into which one spline section of a counterpart spline section on the other part can be received, with the spline sections in engagement to provide a drive coupling therebetween.

10. The down-hole hammer according to claim 9 wherein said one part comprises the drive means.

11. The down-hole hammer according to claim 9 wherein said other part comprises the drill bit.

12. The down-hole hammer according to claim 9 wherein said one part comprises the drill bit.

13. The down-hole hammer according to claim 9 wherein said other part comprises the drive means.

14. The down-hole hammer according to claim 9 wherein the retention gap is closed at one end to prevent axial separation between the drill bit and the drive means.

15. The down-hole hammer according to claim 14 wherein the gap is closed by a circumferential web extending between the two spline sections.

16. The down-hole hammer according to claim 9 wherein a clearance space is defined at one end of one spline section defining the retention gap to permit the counterpart spline section to pass therethrough and be moved into alignment with the retention gap upon relative rotation between the drill bit and the drive means.

17. A down-hole hammer comprising a drill bit and a drive collar with an interconnection therebetween for causing rotation of the drill bit upon rotation of the drive collar, the drill bit comprising a drill bit head and a shank, the drill bit head comprising a cutting face and a circumferential face adjacent the cutting face, the shank extending from the drill bit head in the direction away from the cutting face, the interconnection between the drill bit and the drive collar comprising a spline assembly comprising two spline sections circumferentially offset on the circumferential face of the drill bit head for mating engagement with at least one counterpart spline on the drive collar to provide a drive coupling therebetween.

18. An assembly comprising a drill bit and a drive member with an interconnection therebetween for causing rotation of the drill bit upon rotation of the drive member, the drill bit comprising a drill bit head and a shank, the drill bit head comprising a cutting face and a circumferential face adjacent the cutting face, the shank extending from the drill bit head in the direction away from the cutting face, the interconnection between the drill bit and the drive member comprising a spline assembly comprising two spline sections circumferentially offset on the circumferential face of the drill bit head for mating engagement with at least one counterpart spline on the drive member to provide a drive coupling therebetween.

19. A drill bit for an assembly according to claim 18.

20. A drive member for an assembly according to claim 18.

21. The drive member according to claim 20 wherein the drive member comprises a drive collar.

22. A drill bit comprising a drill head comprising a cutting face and a circumferential face adjacent the cutting face, a shank extending from the drill bit head, and two spline sections circumferentially offset provided on the circumferential face of the drill bit head to cooperate with a mating spline on a part of a down-hole hammer in which the drill bit is adapted to be received.

* * * * *